US010142757B2

(12) United States Patent
Tsukagoshi

(10) Patent No.: US 10,142,757 B2
(45) Date of Patent: Nov. 27, 2018

(54) TRANSMISSION DEVICE, TRANSMISSION METHOD, RECEPTION DEVICE, AND RECEPTION METHOD

(71) Applicant: SONY CORPORATION, Tokyo (JP)

(72) Inventor: Ikuo Tsukagoshi, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/505,622

(22) PCT Filed: Oct. 13, 2015

(86) PCT No.: PCT/JP2015/078875

§ 371 (c)(1),
(2) Date: Feb. 22, 2017

(87) PCT Pub. No.: WO2016/060101

PCT Pub. Date: Apr. 21, 2016

(65) Prior Publication Data

US 2017/0289720 A1 Oct. 5, 2017

(30) Foreign Application Priority Data

Oct. 16, 2014 (JP) ..... 2014-212116

(51) Int. Cl.
*H04S 3/00* (2006.01)
*G10L 19/008* (2013.01)
(Continued)

(52) U.S. Cl.
CPC ..... *H04S 3/008* (2013.01); *G10L 19/008* (2013.01); *G10L 19/167* (2013.01); *H04R 5/02* (2013.01);
(Continued)

(58) Field of Classification Search
CPC ..... H04S 3/008; H04S 7/301; H04S 2400/11; H04S 2400/03; H04S 2420/03; G10L 19/008; G10L 19/167; G10L 19/20; H04R 5/02; H04R 5/04
See application file for complete search history.

(56) References Cited

U.S. PATENT DOCUMENTS

2010/0017002 A1* 1/2010 Oh ..... G10L 19/008 700/94
2010/0017003 A1 1/2010 Oh et al.
(Continued)

FOREIGN PATENT DOCUMENTS

JP 2006-139827 A 6/2006
JP 2011-528446 A 11/2011
(Continued)

OTHER PUBLICATIONS

Juergen Herre, et al., "MPEG Spatial Audio Object Coding—The ISO/MPEG Standard for Efficient Coding of Interactive Audio Scenes", Journal of the Audio Engineering Society, vol. 60, No. 9, Sep. 2012, pp. 655-673.
(Continued)

*Primary Examiner* — Jason R Kurr
(74) *Attorney, Agent, or Firm* — Oblon, McClelland, Maier & Neustadt, L.L.P.

(57) ABSTRACT

A new service can be provided as maintaining the compatibility with a related audio receiver, without deteriorating an efficient usage of a transmission band. A predetermined number of audio streams having first encoded data and second encoded data which is related to the first encoded data are generated, and a container in a predetermined format including these audio streams is transmitted. The predetermined number of audio streams are generated so that the second encoded data is discarded in a receiver which is not compatible with the second encoded data.

20 Claims, 28 Drawing Sheets

(51) Int. Cl.

| | |
|---|---|
| ***G10L 19/16*** | (2013.01) |
| ***H04R 5/02*** | (2006.01) |
| ***H04R 5/04*** | (2006.01) |
| ***H04S 7/00*** | (2006.01) |
| *G10L 19/20* | (2013.01) |

(52) U.S. Cl.
CPC ..... *H04R 5/04* (2013.01); *H04S 7/301* (2013.01); *G10L 19/20* (2013.01); *H04S 2400/03* (2013.01); *H04S 2420/03* (2013.01)

(56) References Cited

U.S. PATENT DOCUMENTS

| | | | | |
|---|---|---|---|---|
| 2012/0030253 | A1 | 2/2012 | Katsumata | |
| 2013/0287364 | A1 | 10/2013 | Katsumata | |
| 2014/0105422 | A1 | 4/2014 | Oh et al. | |
| 2016/0125887 | A1* | 5/2016 | Purnhagen | G10L 19/008 381/22 |
| 2017/0180905 | A1* | 6/2017 | Purnhagen | H04S 7/302 |

FOREIGN PATENT DOCUMENTS

| | | | |
|---|---|---|---|
| JP | 2012-33243 | A | 2/2012 |
| JP | 2014-520491 | A | 8/2014 |

OTHER PUBLICATIONS

International Search Report dated Dec. 15, 2015 in PCT/JP2015/078875 filed Oct. 13, 2015.

* cited by examiner

FIG. 5

| groupID | attribute | switchGroupID | presetGroupID [1] | presetGroupID [2] | StreamID | Kind |
|---|---|---|---|---|---|---|
| 1 | Object sound | 0 | 1 | 1 | 0 | |
| 2 | Object language1 | 1 | 2 | | 0 | |
| 3 | Object language2 | 1 | | 3 | 0 | |

MPEG4 AAC Audio Frame CONFIGURATION

FIG. 7

Syntax of data_stream_element

| Syntax | No.of bits | Mnemonic |
|---|---|---|
| data_stream_element () | | |
| { | | |
| element_instance_tag; | 4 | uimsbf |
| data_byte_align_flag; | 1 | uimsbf |
| cnt=count | 8 | uimsbf |
| if (cn t==255) { | | |
| Cnt + = esc_count; | 8 | uimsbf |
| } | | |
| if (data_byte_align_flg) { | | |
| byte_alignment (); | | |
| } | | |
| for (I = 0, i<cnt, i++) { | | |
| data_stream_byte [element_instance_tag] [i]; | 8 | uimsbf |
| } | | |
| } | | |

FIG. 8

Syntax of metadata (a)

| Syntax | No. of Bits | Format |
|---|---|---|
| metadata (){ | | |
| sync_code | 8 | uimsbf |
| metadata_type | 8 | uimsbf |
| count | 8 | uimsbf |
| for (i = 0; i < N ; i++) { | | |
| data_byte | 8 | uimsbf |
| } | | |
| } | | |

(b)

sync_code (8bis) *'xx' (TBD)* metadata_type (8bits) INDICATES TYPE OF METADATA.

'0x10' OBJECT ENCODED DATA OF MPEG-H SYSTEM count (8bits) INDICATES COUNT NUMBER OF METADATA IN TIME-SERIES ASCENDING ORDER.

OBJECT ENCODED DATA IS PLACED IN data_byte AREA.

PACKET CONFIGURATION EXAMPLE OF OBJECT ENCODED DATA

FIG. 11

Ancillary_data_descriptor

| Syntax | No. of Bits | Format |
|---|---|---|
| Ancillary_data_descriptor (){ | | |
| descriptor_tag | 8 | uimsbf |
| descriptor_length | 8 | uimsbf |
| ancillary_data_identifier | 8 | bslbf |
| } | | |

FIG. 12

| Ancillary_data_identifier (Bit number) | Description |
|---|---|
| b0 | DVD-Video Ancillary Data (TS 101 154 [9]) |
| b1 | Extended Ancillary Data (TS 101 154 [9]) |
| b2 | Announcement Switching Data (TS 101 154 [9]) |
| b3 | DAB Ancillary Data (EN 300 401 [2]) |
| b4 | Scale Factor Error Check (ScF-CRC)(TS 101 154 [9]) |
| b5 | MPEG-4 ancillary data (TS 101 154 [9], clause C 5) |
| b6 | RDS via UECP (TS 101 154 [9]) |
| b7 | Reserved for future use |

Object data

FIG. 13

3Daudio_stream_config_descriptor

| Syntax | No. of Bits | Format |
|---|---|---|
| 3Daudio_stream_config_descriptor(){ | | |
| descriptor_tag | 8 | uimsbf |
| descriptor_length | 8 | uimsbf |
| NumOfGroups, N | 8 | uimsbf |
| NumOfPresetGroups, P | 8 | uimsbf |
| for (i = 0 ; i < N ; i++){ | | |
| groupID | 8 | uimsbf |
| attribute_of_groupID | 8 | uimsbf |
| SwitchGroupID | 8 | uimsbf |
| contentKind | 8 | uimsbf |
| audio_streamID | 8 | uimsbf |
| } | | |
| for (j = 0 ; j < P ; j++){ | | |
| presetGroupID | 8 | uimsbf |
| NumOfGroups_in_preset, R | 8 | uimsbf |
| for (k = 0 ; k < R ; k++){ | | |
| groupID | 8 | uimsbf |
| } | | |
| } | | |
| } | | |

FIG. 14

Semantics of 3Daudio_stream_config_descriptor

NumOfGroups (8bits)
INDICATES NUMBER OF Groups. (VALUE EQUAL TO OR GREATER THAN 1)
NumOfPresetGroups (8bits)
INDICATES NUMBER OF PresetGroups. (VALUE EQUAL TO OR GREATER THAN 1)
groupID (8bits)
INDICATES group IDENTIFIER. (VALUE OTHER THAN 0)
attribute_of_groupID (8bits)
INDICATES ATTRIBUTE OF ENCODED DATA OF RELEVANT group. (VALUE OTHER THAN 0)
switchGroupID (8bits)
IDENTIFIER INDICATING TO WHICH switchGroup RELEVANT group BELONGS.
'0' DOES NOT BELONG TO ANY switchGroup.
OTHER THAN '0' INDICATES BELONGING switchGroup.
contentKind (8bits)
INDICATES CONTENT TYPE OF group.
audio_streamID (8bits)
IDENTIFIER OF AUDIO STREAM.
presetGroupID (8bits)
IDENTIFIER INDICATING GROUP THAT Group IS PRESET.
NumOfGroups_in_preset (8bits)
INDICATES NUMBER OF Groups BELONGING TO presetGroup.

FIG. 15

| ContentKind | description |
|---|---|
| 0 | undefined |
| 1 | complete main |
| 2 | dialogue |
| 3 | music |
| 4 | effect |
| 5 | mixed |
| 6 | LFE |
| 7 | voiceover |
| 8 | spokensubtitle |
| 9 | audiodescription/visually impaired |
| 10 | commentary |
| 11 | hearing impaired |
| 12 | emergency |
| 13-15 | reserved |

FIG. 19

| groupID | attribute | switchGroupID | presetGroupID [1] | presetGroupID [2] | StreamID | Kind |
|---|---|---|---|---|---|---|
| 1 | Object sound | 0 | 1 | 1 | 1 | |
| 2 | Object language1 | 1 | 2 | | 2 | |
| 3 | Object language2 | 1 | | 3 | 2 | |

FIG. 20

(a)

3Daudio_streamID_descriptor

| Syntax | No. of Bits | Format |
|---|---|---|
| 3Daudio_streamID_descriptor(){ | | |
| descriptor_tag | 8 | uimsbf |
| descriptor_length | 8 | uimsbf |
| audio_streamID | 8 | uimsbf |
| } | | |

(b)

| |
|---|
| audio_streamID (8bits)<br>IDENTIFIER OF SUBSTREAM. |

DECODE PROCESS IN CASE OF STREAM CONFIGURATION (1)

DECODE PROCESS IN CASE OF STREAM CONFIGURATION (2)

AC3 AUXILIARY DATA CONFIGURATION

| Syntax | Word Size |
|---|---|
| auxdata() | |
| { | |
| **auxbits** | **nauxbits** |
| if(auxdatae) | |
| { | |
| **auxdatal** | **14** |
| } | |
| **auxdatae** | **1** |
| } | |
| /* end of auxdata */ | |

Syntax of umd_info

| Syntax | No. of bits | Mnemonic |
|---|---|---|
| umd_info(){ | | |
| umd_version | 2 | uimsbf |
| k_id | 3 | uimsbf |
| ⋮ | | |
| } | | |

Umd_version (2bits) umd SYNTAX VERSION NUMBER
K_id (3bits) INDICATES THAT ARBITRARY INFORMATION IS CONTAINED AS '0x6'.

FIG. 31

Syntax of umd_payload_substream

| Syntax | No. of Bits | Format |
|---|---|---|
| umd_payload_substream() { | | |
| umd_payload_id | 5 | uimsbf |
| umd_payload_size | 16 | Uimsbf |
| userdata_synccode | 8 | uimsbf |
| for ( i=0; i < N; i++){ | | |
| object_data_byte | 8 | uimsbf |
| } | | |
| } | | |

| | |
|---|---|
| umd_payload_id (5bits) | ID VALUE INDICATING THAT object_data_byte IS CONTAINED |
| umd_payload_size (16bts) | INDICATES DATA SIZE SUBSEQUENT TO RELEVANT FIELD |
| userdata_synccode (8bits) | INDICATES START CODE OF METADATA PART<br>INDICATES THAT METADATA IS OBJECT DATA BY '0x10' |

TRANSMISSION DEVICE, TRANSMISSION METHOD, RECEPTION DEVICE, AND RECEPTION METHOD

TECHNICAL FIELD

The present technology relates to a transmission device, a transmission method, a reception device, and a reception method, and more particularly, relates to a transmission device for transmitting a plurality of types of audio data, and the like.

BACKGROUND ART

In related art, as a three-dimensional (3D) sound technology, there is a proposed technology for mapping encoded sample data to a speaker existing at an arbitrary location to render on the basis of metadata (for example, see Patent Document 1).

CITATION LIST

Patent Document

Patent Document 1: Japanese Translation of PCT Publication No. 2014-520491

SUMMARY OF THE INVENTION

Problems to be Solved by the Invention

For example, sound reproduction with an improved realistic feeling is realized in a reception side by transmitting object data composed of encoded sample data and metadata together with channel data of 5.1 channel, 7.1 channel, or the like. In related art, it has been proposed to transmit an audio stream including encoded data which is obtained by encoding channel data and object data by using an MPEG-H 3D Audio (3D audio) encoding method to the reception side.

The 3D audio encoding method and an encoding method such as MPEG4 AAC are not compatible in those stream structures. Thus, when a 3D audio service is provided as maintaining compatibility with a related audio receiver, a simulcast may be considered. However, the transmission band cannot be efficiently used when same content is transmitted by different encoding methods.

An object of the present technology is to provide a new service as maintaining compatibility with a related audio receiver without deteriorating an efficient usage of a transmission band.

Solutions to Problems

A concept of the present technology lies in a transmission device including:

an encoding unit configured to generate a predetermined number of audio streams including first encoded data and second encoded data which is related to the first encoded data; and a transmission unit configured to transmit a container in a predetermined format including the generated predetermined number of audio streams, wherein the encoding unit generates the predetermined number of audio streams so that the second encoded data is discarded in a receiver which is not compatible with the second encoded data.

According to the present technology, the encoding unit generates a predetermined number of audio streams having first encoded data and second encoded data which is related to the first encoded data. Here, the predetermined number of audio streams are generated so that the second encoded data is discarded in a receiver which is not compatible with the second encoded data.

For example, an encoding method of the first encoded data and an encoding method of the second encoded data may be different. In this case, for example, the first encoded data may be channel encoded data and the second encoded data may be object encoded data. In addition, in this case, for example, the encoding method of the first encoded data may be MPEG4 AAC and the encoding method of the second encoded data may be MPEG-H 3D Audio.

The transmission unit transmits a container in a predetermined format including the generated predetermined number of audio streams. For example, the container may be a transport stream (MPEG-2 TS), which is used in a digital broadcasting standard. Further, for example, the container maybe a container of MP4, which is used in distribution through the Internet, or a container in other formats.

As described above, according to the present technology, a predetermined number of audio streams having first encoded data and second encoded data which is related to the first encoded data are transmitted, and the predetermined number of audio streams are generated so that the second encoded data is discarded in a receiver which is not compatible with the second encoded data. Thus, a new service can be provided as maintaining the compatibility with a related audio receiver without deteriorating the efficient usage of the transmission band.

Note that, in the present technology, for example, the encoding unit may generate the audio streams having the first encoded data and embed the second encoded data in a user data area of the audio streams. In this case, in the related audio receiver, the second encoded data embedded in the user data area is read and discarded.

In this case, for example, an information insertion unit configured to insert, in a layer of the container, identification information identifying that there is the second encoded data, which is related to the first encoded data, embedded in the user data area of the audio streams having the first encoded data and included in the container may further be included. With this configuration, in the reception side, it can be easily recognized that there is second encoded data embedded in the user data area of the audio streams before performing a decode process of the audio streams.

In addition, in this case, for example, the first encoded data may be channel encoded data and the second encoded data may be object encoded data, and the object encoded data of a predetermined number of groups may be embedded in the user data area of the audio stream, an information insertion unit configured to insert, in a layer of the container, attribute information that indicates an attribute of each piece of the object encoded data of the predetermined number of groups may further be included. With this configuration, in the reception side, it can be easily recognized that an attribute of each object encoded data of a predetermined number of groups before decoding the object encoded data, so that the only object encoded data of a necessary group can be selectively decoded and used and this can reduce the processing load.

In addition, in the present technology, for example, the encoding unit may generate a first audio stream including the first encoded data and generate a predetermined number of second audio streams including the second encoded data.

In this case, in a related audio receiver, a predetermined number of second audio streams are excluded from the target of decoding. Or, in this system, it is also possible that the first encoded data of 5.1 channel is encoded by using an AAC system and data of 2 channel obtained from the data of 5.1 channel and the encoded object data are encoded as second encoded data by using an MPEG-H system. In this case, a receiver, which is not compatible with the second encoding method, decodes only the first encoded data.

In this case, for example, object encoded data of a predetermined number of groups may be included in the predetermined number of second audio streams, an information insertion unit configured to insert, in a layer of the container, attribute information that indicates an attribute of each piece of object encoded data of the predetermined number of groups may further be included. With this configuration, in the reception side, it can be easily recognized an attribute of each piece of object encoded data of the predetermined number of groups before decoding the object encoded data, and only the object encoded data of a necessary group can be selectively decoded and used so that the processing load can be reduced.

Then, in this case, for example, the information insertion unit may be made to further insert, to the layer of the container, stream correspondence relation information that indicates to which second audio stream the object encoded data of the predetermined number of groups and the channel encoded data and object encoded data of the predetermined number of groups is included respectively. For example, the stream correspondence relation information may be made as information that indicates a correspondence relation between a group identifier identifying each piece of encoded data of the plurality of groups and a stream identifier identifying each stream of the predetermined number of audio streams. In this case, for example, the information insertion unit may be made to further insert, in the layer of the container, stream identifier information that indicates each stream identifier of the predetermined number of audio streams. With this configuration, the reception side can easily recognize object encoded data of a necessary group or a second audio stream that includes the channel encoded data and object encoded data of the predetermined number of groups so that the processing load can be reduced.

In addition, another concept of the present technology lies in

A reception device including a reception unit configured to receive a container in a predetermined format including a predetermined number of audio streams having first encoded data and second encoded data which is related to the first encoded data, wherein the predetermined number of audio streams are generated so that the second encoded data is discarded in a receiver which is not compatible with the second encoded data, the reception device further including a processing unit configured to extract the first encoded data and the second encoded data from the predetermined number of audio streams included in the container and process the extracted data.

According to the present technology, the reception unit receives a container in a predetermined format including a predetermined number of audio streams having first encoded data and second encoded data which is related to the first encoded data. Here, the predetermined number of audio streams are generated so that the second encoded data is discarded in a receiver which is not compatible with the second encoded data. Then, by the processing unit, the first encoded data and second encoded data are extracted from the predetermined number of audio streams and processed.

For example, an encoding method of the first encoded data and an encoding method of the second encoded data may be different. In addition, for example, the first encoded data may be channel encoded data and the second encoded data may be object encoded data.

For example, the container may be made to include an audio stream that has the first encoded data and the second encoded data embedded in a user data area thereof. In addition, for example, the container may include a first audio stream including the first encoded data and a predetermined number of second audio streams including the second encoded data.

In this manner, according to the present technology, the first encoded data and second encoded data are extracted from the predetermined number of audio streams and processed. Therefore, high quality sound reproduction by a new service using the second encoded data in addition to the first encoded data can be realized.

Effects of the Invention

According to the present technology, a new service can be provided as maintaining compatibility with a related audio receiver without deteriorating an efficient usage of a transmission band. It is noted that the effect described in this specification is just an example and does not set any limitation, and there may be additional effects.

BRIEF DESCRIPTION OF DRAWINGS

FIG. 5 is a diagram illustrating a correspondence relation between groups and attributes or the like in a case that the transmission audio stream configuration is the stream configuration (1).

FIG. 7 is a diagram illustrating a data stream element (DSE) configuration to which metadata is inserted.

FIGS. 8(*a*) and 8(*b*) are diagrams illustrating a configuration of "metadata ( )" and major information of the configuration.

FIG. 11 is a diagram illustrating a structure example of an ancillary data descriptor.

FIG. 12 is a diagram illustrating a correspondence relation between current bits and data types of an 8-bit field of "ancillary_data_identifier."

FIG. 13 is a diagram illustrating a configuration example of a 3D audio stream structure descriptor.

FIG. 14 illustrates major information content of the configuration example of the 3D audio stream structure descriptor.

FIG. 15 is a diagram illustrating types of content, which is defined in "contentKind."

FIG. 19 is a diagram illustrating a correspondence relation between groups and attributes in a case that the configuration of the transmission audio stream is the stream configuration (2).

FIGS. 20(*a*) and 20(*b*) are diagrams illustrating a structure example of 3D audio stream ID descriptor.

FIG. 31 is a diagram illustrating a configuration example of "umd_payloads_substream( ))" in the substream (ac4_substream_data( )).

MODE FOR CARRYING OUT THE INVENTION

In the following, modes (hereinafter, referred to as "embodiment") for carrying out the invention will be described. It is noted that the descriptions will be given in the following order.

1. Embodiment
2. Modified Examples

<1. Embodiment>

[Configuration Example of Transceiving System]

Figure 1:
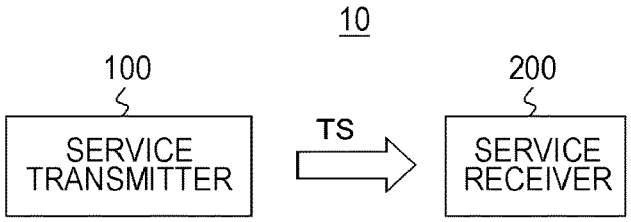
FIG. 1 is a block diagram illustrating a configuration example of a transceiving system as an embodiment.

FIG. 1 illustrates a configuration example of a transceiving system 10 as an embodiment. The transceiving system 10 includes a service transmitter 100 and a service receiver 200. The service transmitter 100 transmits a transport stream TS through a broadcast wave or a packet through a network. The transport stream TS includes a video stream and a predetermined number, which is one or more, of audio stream.

The predetermined number of audio streams include channel encoded data and a predetermined number of groups of object encoded data. The predetermined number of audio streams are generated so that the object encoded data is discarded when a receiver is not compatible with the object encoded data.

Figure 2:
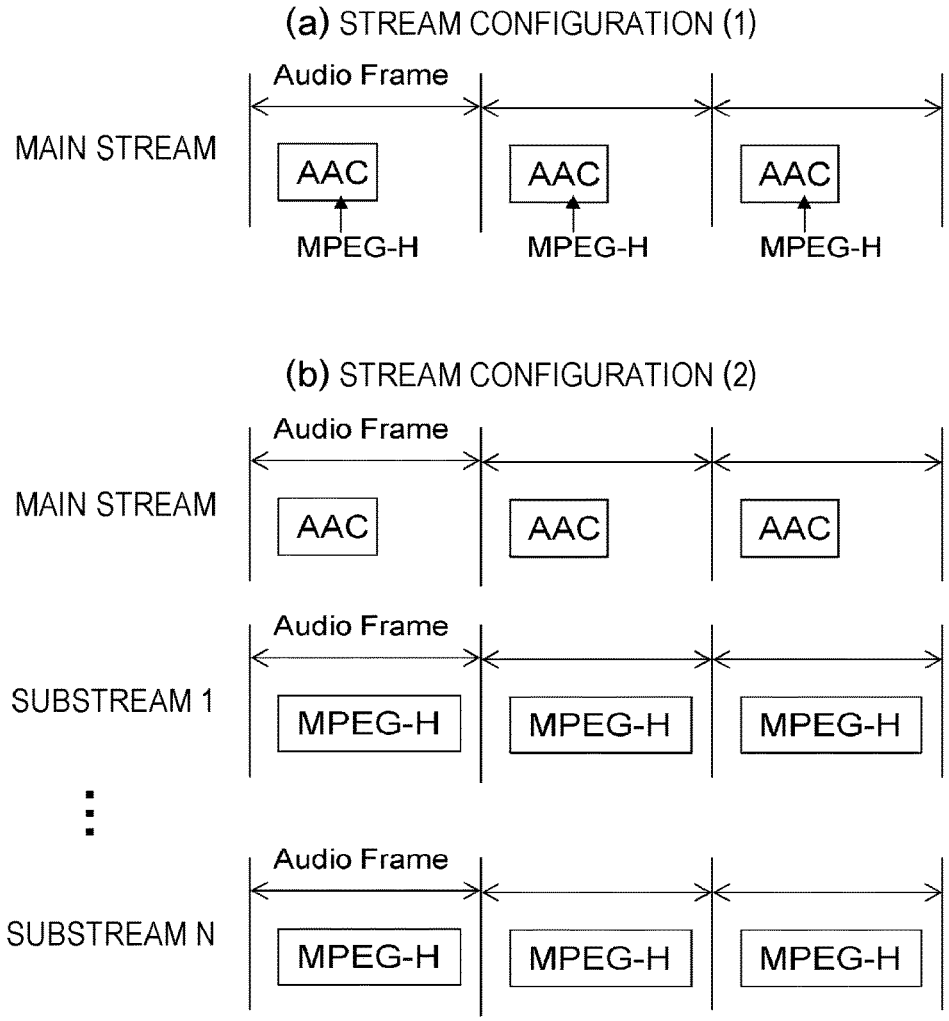
FIGS. 2(*a*) and 2(*b*) are diagrams for explaining transmission audio stream configurations (stream configuration (1) and stream configuration (2)).

In a first method, as illustrated in a stream configuration (1) of FIG. 2(*a*), an audio stream (main stream) including channel encoded data which is encoded with MPEG4 AAC is generated and a predetermined number of groups of object encoded data which is encoded with MPEG-H 3D Audio is embedded in a user data area of the audio stream.

In a second method, as illustrated in a stream configuration (2) of FIG. 2(*b*), an audio stream (main stream) including channel encoded data which is encoded with MPEG4 AAC is generated and a predetermined number of audio streams (substreams 1 to N) including a predetermined number of groups of object encoded data which is encoded with MPEG-H 3D Audio are generated.

The service receiver 200 receives, from the service transmitter 100, a transport stream TS transmitted using a broadcast wave or a packet though a network. As described above, the transport stream TS includes a predetermined number of audio streams including channel encoded data and a predetermined number of groups of object encoded data in addition to a video stream. The service receiver 200 performs a decode process on the video stream and obtains a video output.

Further, when the service receiver 200 is compatible with the object encoded data, the service receiver 200 extracts channel encoded data and object encoded data from the predetermined number of audi streams and performs the decode process to obtain an audio output corresponding to the video output. On the other hand, when the service receiver 200 is not compatible with the object encoded data, the service receiver 200 extracts only channel encoded data from the predetermined number of audi streams and performs a decode process to obtain an audio output corresponding to the video output.

[Stream Generation Unit of Service Transmitter]

(A Case That the Stream Configuration (1) is Employed)

Figure 3:
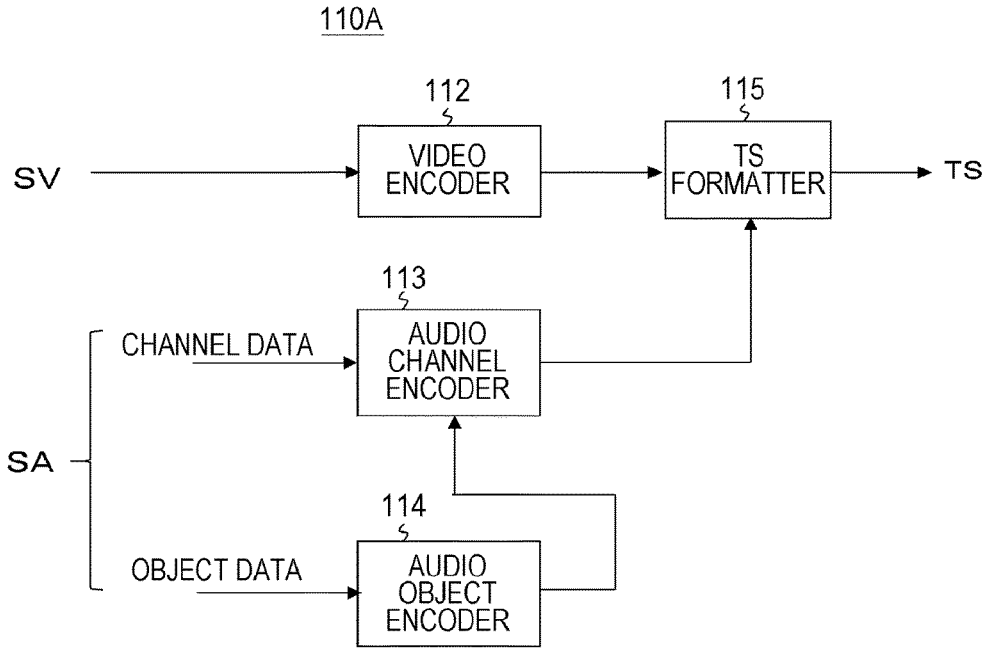
FIG. 3 is a block diagram illustrating a configuration example of a stream generation unit in a service transmitter in a case that the transmission audio stream configuration is the stream configuration (1).

Firstly, a case that the audio stream is in the stream configuration (1) of FIG. 2(*a*) will be described. FIG. 3 illustrates a configuration example of a stream generation unit 110A. included in the service transmitter 100 in the above case.

The stream generation unit 110 includes a video encoder 112, an audio channel encoder 113, an audio object encoder 114, and a TS formatter 115. The video encoder 112 inputs video data SV, encodes the video data SV, and generates a video stream.

The audio object encoder 114 inputs object data that composes audio data SA and generates an audio stream (object encoded data) by encoding the object data with MPEG-H 3D Audio. The audio channel encoder 113 inputs channel data that composes the audio data SA, generates an audio stream by encoding the channel data with MPEG4 AAC, and also embeds the audio stream generated in the audio object encoder 114 in a user data area of the audio stream.

Figure 4:
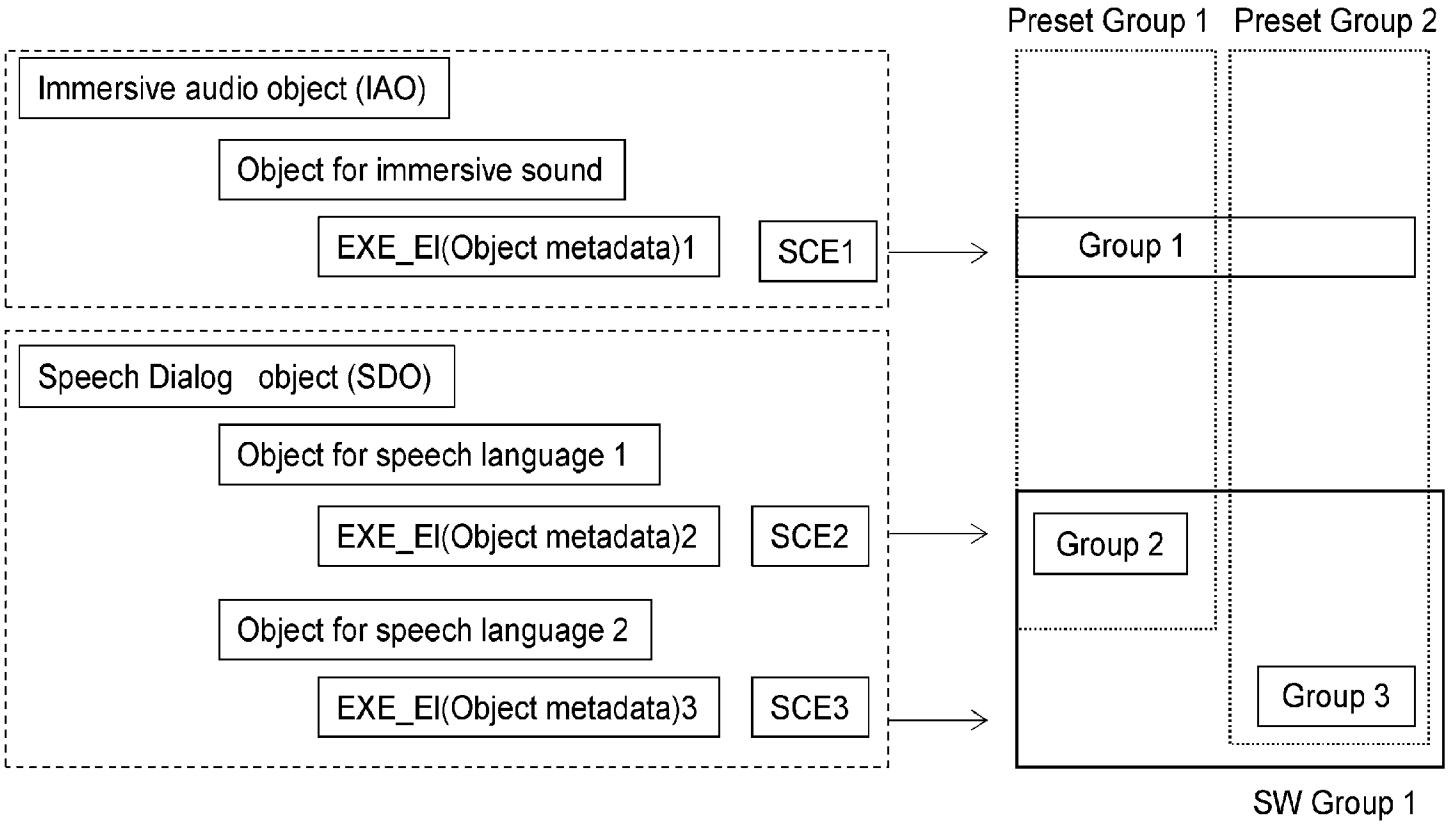
FIG. 4 is a diagram illustrating a configuration example of object encoded data that composes 3D audio transmission data.

FIG. 4 illustrates a configuration example of the object encoded data. In this configuration example, two pieces of object encoded data are included. The two pieces of object encoded data are encoded data of an immersive audio object (IAO) and a speech dialog object (SDO).

Immersive audio object encoded data is object encoded data for an immersive sound and includes encoded sample data SCE1 and metadata EXE_El (Object metadata) 1 for rendering by mapping the encoded sample data SCE1 with a speaker existing at an arbitrary location.

Speech dialogue object encoded data is object encoded data for a spoken language. In this example, there is speech dialogue object encoded data respectively corresponding to first and second languages. The speech dialogue object encoded data corresponding to the first language includes encoded sample data SCE2 and metadata EXE_El (Object metadata) 2 for rendering by mapping the encoded sample data SCE2 with a speaker existing at an arbitrary location. Further, the speech dialogue object encoded data corresponding to the second language includes encoded sample data SCE3 and metadata EXE_El (Object metadata) 3 for rendering by mapping the encoded sample data SCE3 with a speaker existing at an arbitrary location.

The object encoded data is distinguished by using a concept of groups (Group) according to the type of data. According to the illustrated example, the immersive audio object encoded data is set as Group 1, the speech dialogue object encoded data corresponding to the first language is set as Group 2, and the speech dialogue object encoded data corresponding to the second language is set as Group 3.

Further, the data which can be selected between groups in a reception side is registered in a switch group (SW Group) and encoded. Then, those groups can be grouped as a preset group (preset Group) and reproduced according to a use case. In the illustrated example, Group 1 and Group 2 are grouped as Preset Group 1, and Group 1 and Group 3 are grouped as Preset Group 2.

FIG. 5 illustrates a correspondence relation or the like between groups and attributes. Here, a group ID (group ID) is an identifier to identify a group. An attribute (attribute) represents an attribute of encoded data of each group. A switch group ID (switch Group ID) is an identifier to identify a switching group. A reset group ID (preset Group ID) is an identifier to identify a preset group. A stream ID (sub Stream ID) is an identifier to identify a stream. A kind (Kind) represents a kind of content of each group.

The illustrated correspondence relation indicates that the encoded data of Group 1 is object encoded data for an immersive sound (immersive audio object encoded data), composes a switch group, and is embedded in a user data area of the audio stream including channel encoded data.

Further, the illustrated correspondence relation indicates that the encoded data of Group 2 is object encoded data for a spoken language (speech dialogue object encoded data) of the first language, composes Switch Group 1, and is embedded in a user data area of the audio stream including channel encoded data. Further, the illustrated correspondence relation indicates that the encoded data of Group 3 is object encoded data for a spoken language (speech dialogue object encoded data) of the second language, composes Switch Group 1, and is embedded in a user data area of the audio stream including channel encoded data.

Further, the illustrated correspondence relation indicates that Preset Group 1 includes Group 1 and Group 2. In addition, the illustrated correspondence relation indicates that Preset Group 2 includes Group 1 and Group 3.

Figure 6:
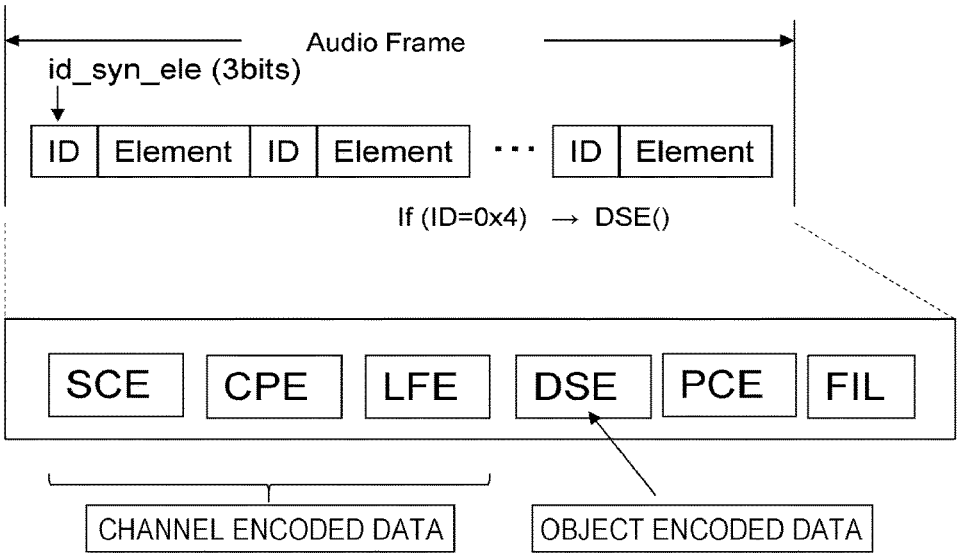
FIG. 6 is a diagram illustrating an MPEG4 AAC audio frame structure.

FIG. 6 illustrates an audio frame structure of MPEG4 AAC. The audio frame includes a plurality of elements. At the beginning of each element (element), there is a three-bit identifier (ID) of "id_syn_ele" and an element content can be identified.

The audio frame includes elements such as a single channel element (SCE), a channel pair element (CPE), a low frequency element (LFE), a data stream element (DSE), a program config element (PCE), and a fill element (FIL). The elements of SCE, CPE, and LFE include encoded sample data that composes channel encoded data. For example, in a case of channel encoded data of 5.1 channel, there included a single SCE, two CPEs, and a single LFE.

The element of PCE includes a number of channel elements and a downmix (down_mix) factor. The element of FIL is used to define extension (extension) information. In the element of DSE, user data can be placed and "id_syn_ele" of this element is "0x4." In DSE, object encoded data is embedded.

FIG. 7 illustrates a configuration (Syntax) of DSE (Data Stream Element ( )). A 4-bit field of "element_instance_tag" represents a type of data in DSE; however, this value may be set to "0" when the DSE is used as common user data. The field of "data_byte_align_flag" is set to "1" so that the bytes of the entire DSE are aligned. A value of "count" or "esc_count" which represents a number of its added bytes is properly set according to a user data size. The "count" and "esc_count" can count up to 510 bytes. In other words, the size of the data placed in a single DSE is 510 bytes at a maximum. To "data_stream_byte" field, "metadata ( )" is inserted.

FIG. 8(*a*) illustrates a configuration (Syntax) of "metadata ( )" and FIG. 8(*b*) illustrates content (semantics) of main information in the configuration. An 8-bit field of "metadata_type" indicates a type of metadata. For example, "0x10" represents object encode data of the MPEG-H system (MPEG-H 3D Audio).

An 8-bit field of "count" indicates a count number of metadata in ascending chronological order. As described above, the size of data placed in a single DSE is up to 510 bytes; however, the size of object encoded data may be larger than 510 bytes. In such a case, more than one DSEs are used and the count number indicated by "count" is made to represent a link of those DSEs. In an area of "data_byte, " object encoded data is placed.

Figure 9:
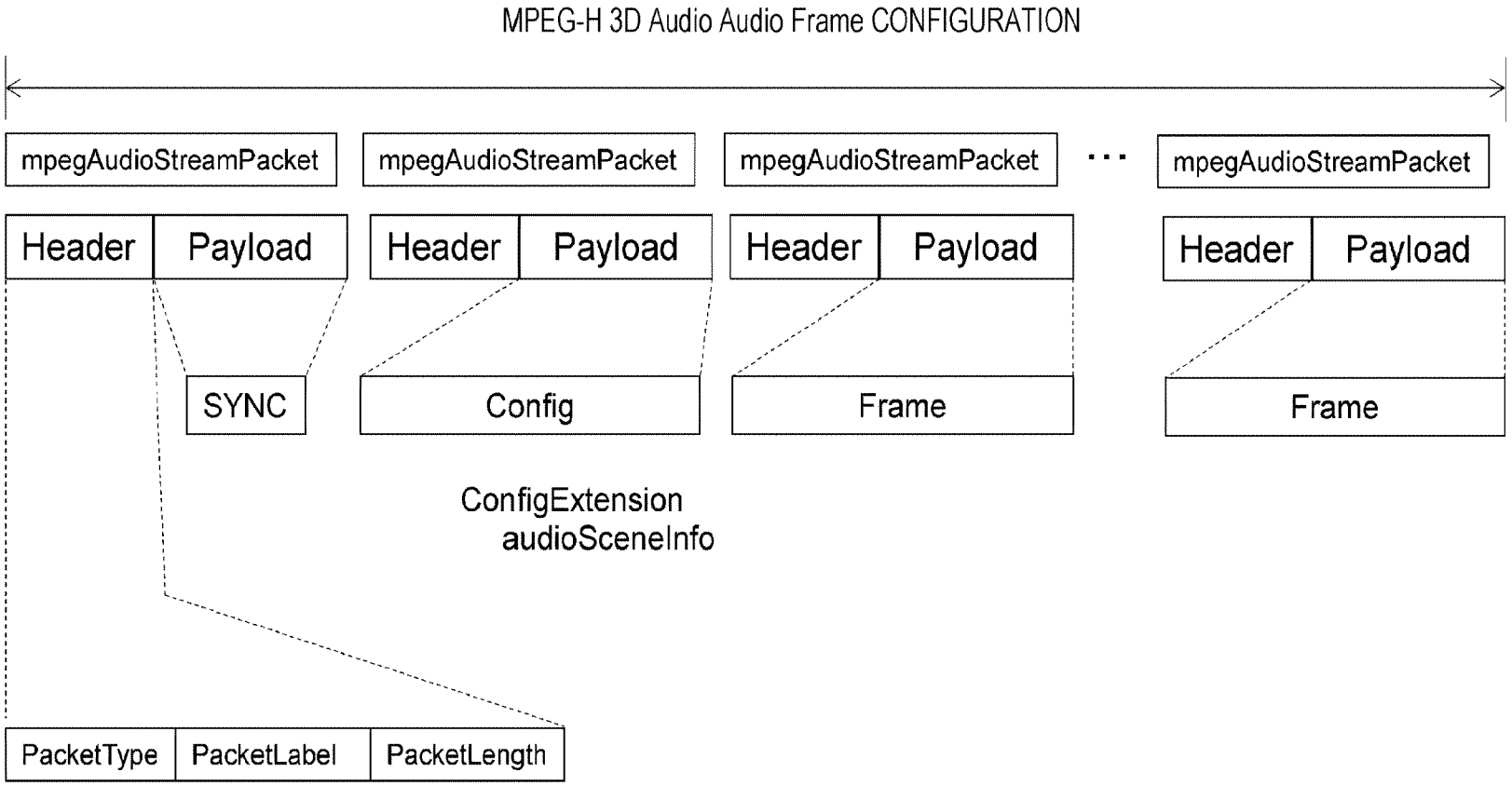
FIG. 9 is a diagram illustrating an audio frame structure of MPEG-H 3D Audio.

FIG. 9 illustrates an audio frame structure of MPEG-H 3D Audio. This audio frame is composed of a plurality of MPEG audio stream packets (mpeg Audio Stream Packet). Each MPEG audio stream packet is composed of a header (Header) and a payload (Payload).

The header includes information such as a packet type (Packet Type), a packet label (Packet Label), and a packet length (Packet Length). In the payload, information defined by the packet type in the header is placed. The payload information includes "SYNC" corresponding to a synchronizing start code, "Frame" which is actual data, and "Config" which represents a configuration of "Frame."

According to the present embodiment, "Frame" includes object encoded data that composes 3D audio transmission data. The channel encoded data composing the 3D audio transmission data is included in the audio frame of MPEG4 AAC as described above. The object encoded data is composed of encoded sample data of single channel element (SCE) and metadata for rendering by mapping the encoded sample data with a speaker existing at an arbitrary location (see FIG. 4). The metadata is included as an extension element (Ext_element).

Figure 10:
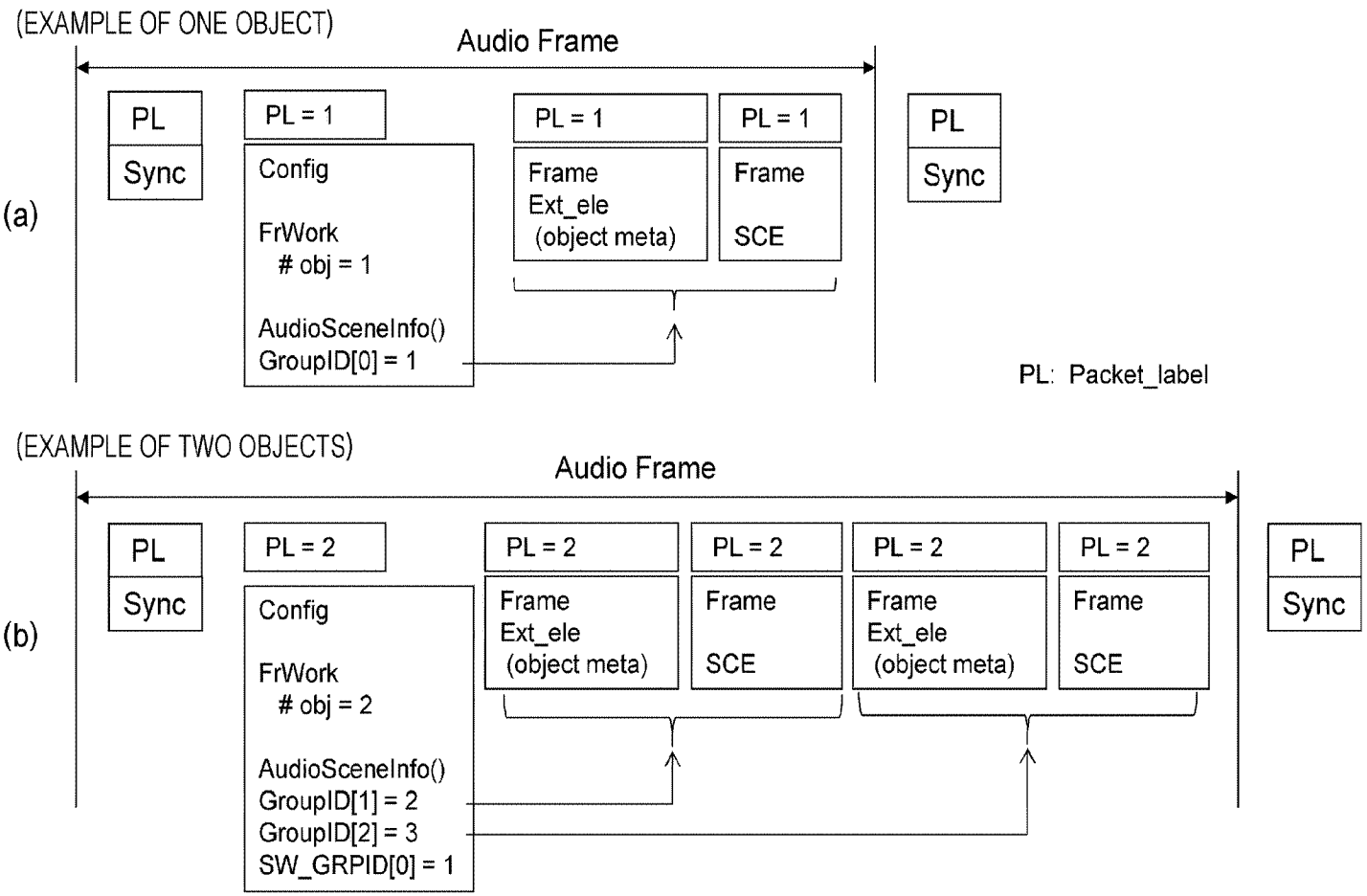
FIGS. 10(*a*) and 10(*b*) are diagrams illustrating packet configuration examples of object encoded data.

FIG. 10(*a*) illustrates a packet configuration example of the object encoded data. In this example, object encoded data of a single group is included. The information of "#obj=1" included in "Config" indicates an existence of "Frame" including the object encoded data of a single group.

The information of "GroupID[0]=1" registered in "AudioSceneInfo( )" in "Config" indicates that "Frame" including the encoded data of Group 1 is placed. Here, a value of a packet label (PL) is made to be a same value in "Config" and each "Frame" corresponding thereto. Here, "Frame" including the encoded data of Group 1 is composed of "Frame" including metadata as an extension element (Ext_element) and "Frame" including encoded sample data of the single channel element (SCE).

FIG. 10(*b*) illustrates another packet configuration example of the object encoded data. In this example, object encoded data of two groups is included. The information of "#obj=2" included in "Config" indicates that there is "Frame" that has object encoded data of two groups.

The information of "GroupID[1]=2, GroupID[2]=3, SW_GRPID[0]=1" registered in "AudioSceneInfo ( )" in this order in "Config" indicates that "Frame" having encoded data of Group 2 and "Frame" having encoded data having Group 3 are placed in this order and these groups compose Switch Group 1. Here, a value of a packet label (PL) is set as a same value in "Config" and each "Frame" corresponding thereto.

Here, "Frame" having the encoded data of Group 2 is composed of "Frame" including metadata as an extension element (Ext_element) and "Frame" including encoded sample data of a single channel element (SCE). Similarly, "Frame" having the encoded data of Group 3 is composed of "Frame" including metadata as an extension element (Ext_element) and "Frame" including encoded sample data of a single channel element (SCE).

Referring back to FIG. 3, the TS formatter 115 packetizes a video stream output from the video encoder 112 and an audio stream output from the audio channel encoder 113 as a PES packet, further multiplexes by packetizing the data as a transport packet, and obtains a transport stream TS as a multiplexed stream.

Further, the TS formatter 115 inserts identification information that identifies that the object encoded data related to the channel encoded data included in the audio stream is embedded to the user data area of the audio stream in a layer of a container, which is in coverage of a program map table (PMT) according to the present embodiment. The TS formatter 115 inserts the identification information to an audio elementary stream loop corresponding to the audio stream by using an existing ancillary data descriptor (Ancillary_data_descriptor).

FIG. 11 illustrates a structure example (Syntax) of the ancillary data descriptor. An 8-bit field of "descriptor_tag" indicates a descriptor type. In this case, the field indicates an ancillary data descriptor. An 8-bit field of "descriptor_length" indicates a length (size) of a descriptor and indicates a number of following bytes as the length of the descriptor.

An 8-bit field of "ancillary_data_identifier" indicates what kind of data is embedded in the user data area of the audio stream. In this case, when each bit is set to "1," it is indicated that data of a type corresponding to the bit is embedded. FIG. 12 illustrates a correspondence relation between bits and data types in a current condition. According to the present embodiment, object encoded data (Object data) is newly defined to Bit 7 as a data type and, when "1" is set to Bit 7, it is identified that object encoded data is embedded in the user data area of the audio stream.

Further, the TS formatter 115 inserts attribute information that indicates respective attributes of object encoded data of the predetermined number of groups in the layer of the container, which is in coverage of the program map table (PMT) according to the present embodiment. The TS formatter 115 inserts the attribute information or the like to the audio elementary stream loop corresponding to the audio stream by using a 3D audio_stream_configuration_descriptor (3D audio_stream_config_descriptor).

FIG. 13 illustrates a structure example (Syntax) of the 3D audio stream configuration descriptor. Further, FIG. 14 illustrates content (Semantics) of main information in the structure example. An 8-bit field of "descriptor_tag" indicates a descriptor type. In this example, the 3D audio stream configuration descriptor is indicated. An 8-bit field of "descriptor_length" indicates a length (size) of the descriptor and a number of following bytes are indicated as the descriptor length.

An 8-bit field of "NumOfGroups, N" indicates a number of groups. An 8-bit field of "NumOfPresetGroups, P" indicates a number of preset groups. An 8-bit field of "groupID," an 8-bit field of "attribute_of_groupID," an 8-bit field of "SwitchGroupID," and an 8-bit field of "audio_streamID" are repeated as many times as the number of groups.

A field of "groupID" indicates an identifier of a group. A field of "attribute_of_groupID" indicates an attribute of object encoded data of the group. A field of "SwitchGroupID" is an identifier indicating to which switch group the group belongs. "0" indicates that the group does not belong to any switch group. Values other than "0" indicate a switch group to which the group belongs. An 8-bit field of "contentKind" indicates a type of content of the group. "audio_streamID" is an identifier indicating an audio stream in which the group is included. FIG. 15 indicates a type of content defined by "contentKind."

Further, an 8-bit field of "presetGroupID" and an 8-bit field of "NumOfGroups_in_preset, R" are repeated as many times as the number of preset groups. A field of "presetGroupID" is an identifier indicating grouped groups as a preset. A field of "NumOfGroups_in_preset, R" indicates a number of groups which belongs to the preset group. Then, in every preset group, an 8-bit field of "groupID" is repeated as many times as the number of the groups which belong to the present group and the groups which belong to the preset group are indicated.

Figure 16:
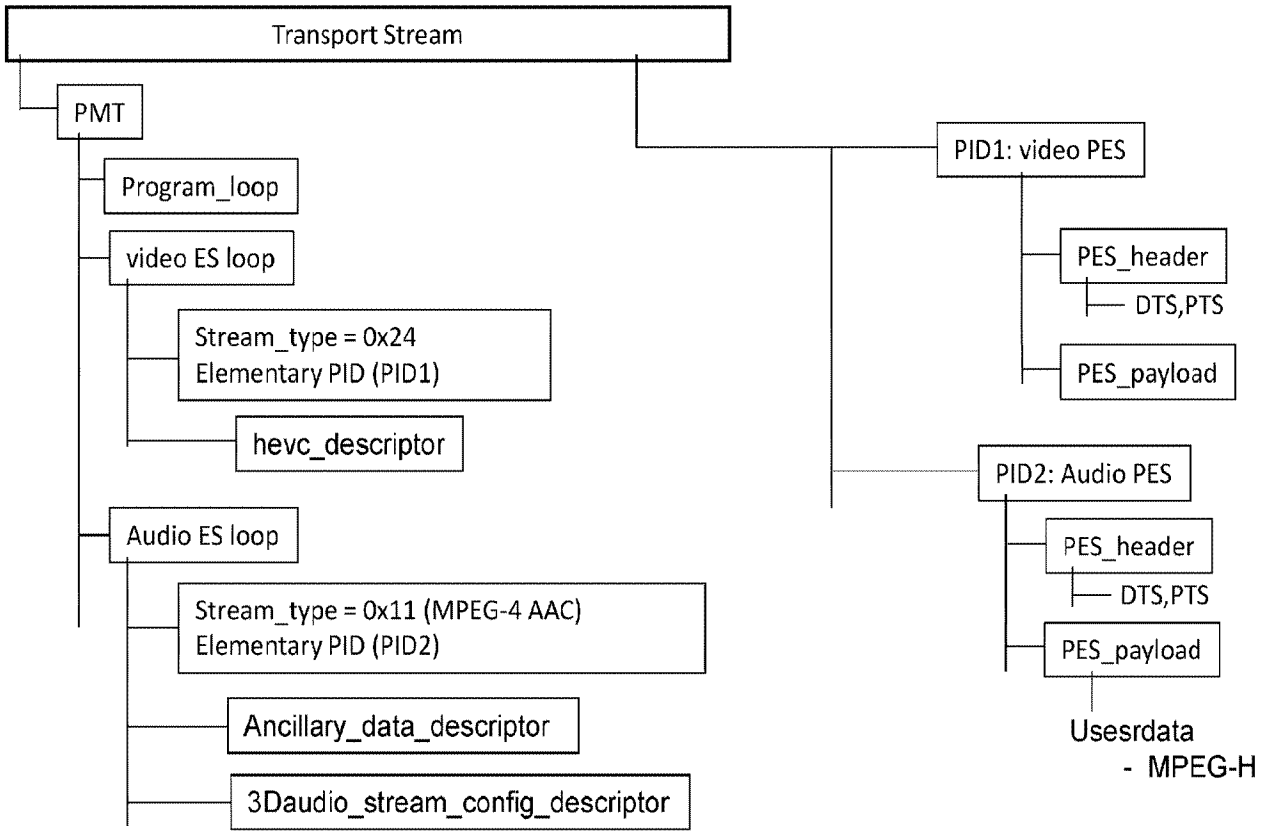
FIG. 16 is a diagram illustrating a configuration example of a transport stream in a case that the configuration of the transmission audio stream is the stream configuration (1).

FIG. 16 illustrates a configuration example of the transport stream TS. In this configuration example, there is "video PES" which is a PES packet of a video stream identified by PID1. Further, in this configuration example, there is "audio PES" which is a PES packet of an audio stream identified by PID2. The PES packet is composed of a PES header (PES_header) and a PES payload (PES_payload).

Here, in the "audio PES" which is a PES packet of an audio stream, MPEG4 AAC channel encoded data is included and MPEG-H 3D Audio object encoded data is embedded in the user data area thereof.

Further, in the transport stream TS, the program map table (PMT) is included, as program specific information (PSI). The PSI is information that describes to which program each elementary stream included in the transport stream belongs. In the PMT, there is a program loop (Program loop) that describes information related to the entire program.

Further, in the PMT, there is an elementary stream loop having information related to each elementary stream. In this configuration example, there is a video elementary stream loop (video ES loop) corresponding to a video stream as well as an audio elementary stream loop (audio ES loop) corresponding to an audio stream.

In the video elementary stream loop (video ES loop), corresponding to the video stream, there provided is information such as a stream type, a packet identifier (PID), or the like as well as a descriptor that describes information related to the video stream. A value of "Stream_type" of the video stream is set as "0x24" and PID information indicates PID1 applied to "video PES" which is a PES packet of a video stream as described above. As one of the descriptors, HEVC descriptor is placed.

In the audio elementary stream loop (audio ES loop), corresponding to the audio stream, there provided is information such as a stream type, a packet identifier (PID) or the like as well as a descriptor that describes information related to the audio stream. A value of "Stream_type" of the audio stream is set to "0x11" and the PID information indicates PID2 applied to "audio PES" which is a PES packet of an audio stream as described above. In the audio elementary stream loop, both of the above described ancillary data descriptor and 3D audio stream configuration descriptor are provided.

Operation of the stream generation unit 110A indicated in FIG. 3 is briefly explained. The video data SV is supplied to the video encoder 112. In the video encoder 112, the video data SV is encoded and a video stream including the encoded video data is included. The video stream is provided to the TS formatter 115.

The object data composing the audio data SA is supplied to the audio object encoder 114. In the audio object encoder 114, MPEG-H 3D Audio encoding is performed on the object data and an audio stream (object encoded data) is generated. This audio stream is supplied to the audio channel encoder 113.

The channel data composing the audio data SA is supplied to the audio channel encoder 113. In the audio channel encoder 113, MPEG4 AAC encoding is performed on the channel data and an audio stream (channel encoded data) is generated. In this case, in the audio channel encoder 113, the audio stream (object encoded data) generated in the audio object encoder 114 is embedded in the user data area.

The video stream generated in the video encoder 112 is supplied to the TS formatter 115. Further, the audio stream generated in the audio channel encoder 113 is supplied to the TS formatter 115. In the TS formatter 115, streams provided from each encoder are packetized as PES packets, then packetized as transport packets and multiplexed, and a transport stream TS as a multiplexed stream is obtained.

Further, in the TS formatter 115, an ancillary data descriptor is inserted in the audio elementary stream loop. This descriptor includes identification information that identifies that there is object encoded data embedded in the user data area of the audio stream.

Further, in the TS formatter 115, a 3D audio stream configuration descriptor is inserted in the audio elementary stream loop. This descriptor includes attribute information that indicates attribute of each piece of object encoded data of the predetermined number of groups.

(A Case that the Stream Configuration (2) is Employed)

Figure 17:
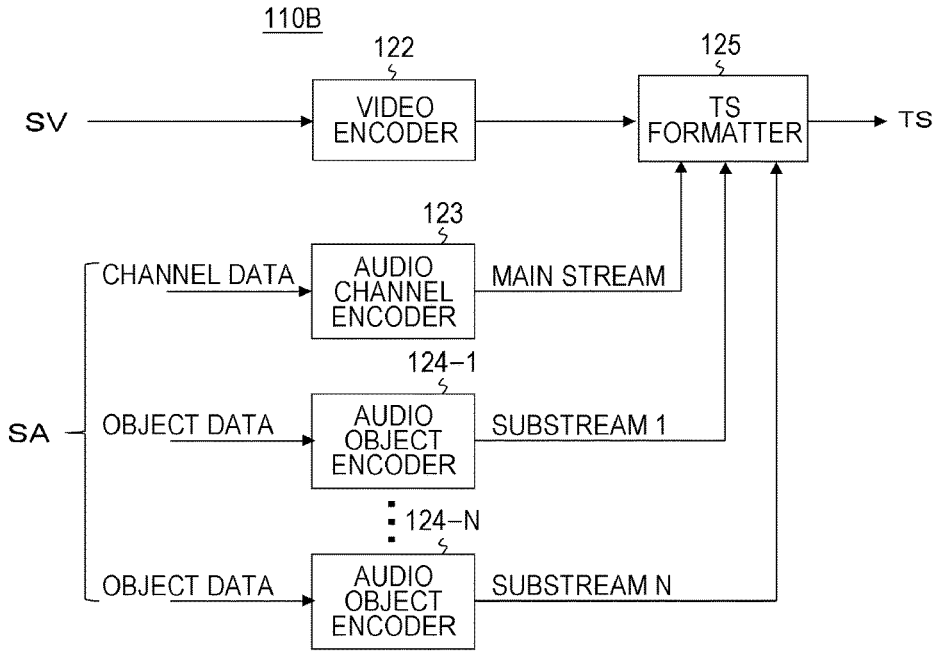
FIG. 17 is a block diagram illustrating a configuration example of a stream generation unit of a service transmitter in a case that the configuration of the transmission audio stream is the stream configuration (2).

Next, a case that the audio stream is in the stream configuration (2) of FIG. 2(*b*) will be described. FIG. 17 illustrates a configuration example of a stream generation unit 110B included in the service transmitter 100 in the above case.

The stream generation unit 110B includes a video encoder 122, an audio channel encoder 123, audio object encoders 124-1 to 124-N, and a TS formatter 125. The video encoder 122 inputs video data SV and encodes the video data SV to generate a video stream.

The audio channel encoder 123 inputs channel data composing audio data SA and encodes the channel data with MPEG4 AAC to generate an audio stream (channel encoded data) as a main stream. The audio object encoders 124-1 to 124-N respectively input object data composing the audio data SA and encode the object data with MPEG-H 3D Audio to generate audio streams (object encoded data) as substreams.

Figure 18:
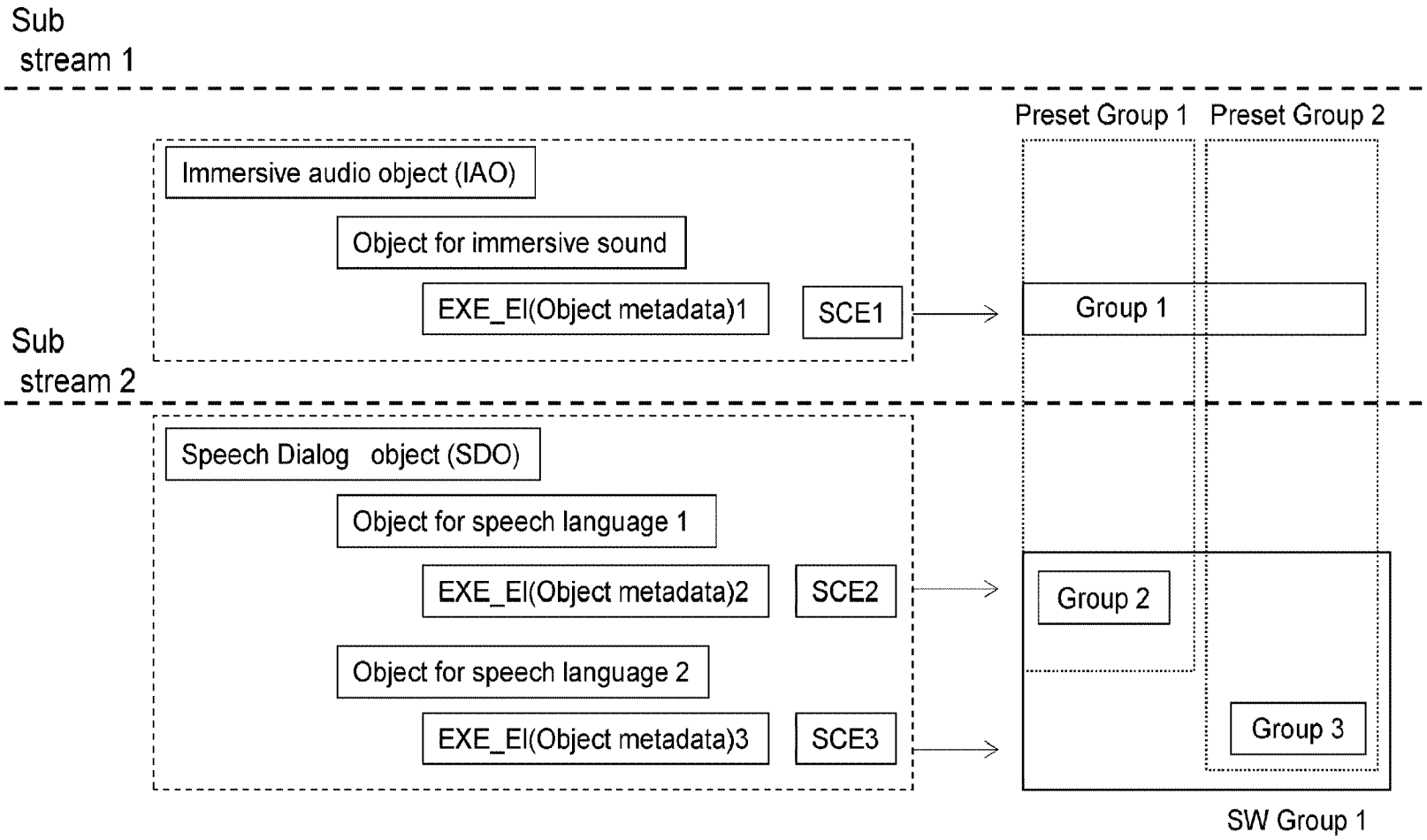
FIG. 18 is a diagram illustrating a configuration example (divided into two) of object encoded data composing 3D audio transmission data.

For example, in a case of N=2, the audio object encoder 124-1 generates substream 1 and the audio object encoder 124-2 generates substream 2. For example, as illustrated in FIG. 18, in the configuration example of the object encoded data composed of two pieces of object encoded data, the substream 1 includes an immersive audio object (IAO) and the substream 2 includes encoded data of a speech dialog object (SDO).

FIG. 19 illustrates a correspondence relation between groups and attributes. Here, a group ID (group ID) is an identifier to identify a group. An attribute (attribute) indicates an attribute of encoded data of each group. A switch group ID (switch Group ID) is an identifier to identify groups which are switchable to each other. A preset group ID (preset Group ID) is an identifier to identify a preset group. A stream ID (Stream ID) is an identifier to identify a stream. A kind (Kind) indicates the type of content of each group.

The illustrated correspondence relation illustrates that the encoded data belonging to Group 1 is object encoded data (immersive audio object encoded data) for an immersive sound, does not compose a switch group, and is included in substream 1.

Further, the illustrated correspondence relation illustrates that the encoded data belonging to Group 2 is object encoded data (speech dialogue object encoded data) for a spoken language of the first language, composes Switch Group 1, and is included in substream 2. Further, the illustrated correspondence relation illustrates that the encoded data belonging to Group 3 is object encoded data (speech dialogue object encoded data) for a spoken language of the second language, composes Switch Group 1, and is included in substream 2.

Further, the illustrated correspondence relation illustrates that Preset Group 1 includes Group 1 and Group 2. Further, the illustrated correspondence relation illustrates that Preset Group 2 includes Group 1 and Group 3.

Referring back to FIG. 17, the TS formatter 125 packetizes the video stream output from the video encoder 112, the audio stream output from the audio channel encoder 123, and further the audio streams output from the audio object encoders 124-1 to 124-N as PES packets, multiplexes the data as transport packets, and obtains a transport stream TS as a multiplexed stream.

Further, in the coverage of the layer of the container, which is in the coverage of the program map table (PMT) in this embodiment, the TS formatter 125 inserts attribute information indicating each attribute of object encoded data in the predetermined number of groups and stream correspondence relation information indicating to which substream the object encoded data in the predetermined number of groups belong. The TS formatter 125 inserts these pieces of information to the audio elementary stream loop corresponding to one or more substream among the predetermined number of substreams by using the 3D audio stream configuration descriptor (3Daudio_stream_config_descriptor) (see FIG. 13).

Further, in the coverage of the layer of the container, which is in the coverage of the program map table (PMT) in this embodiment, the TS formatter 125 inserts stream identifier information indicating each stream identifier of the predetermined number of substreams. The TS formatter 125 inserts the information to the audio elementary stream loops respectively corresponding to the predetermined number of substreams by using the 3D audio stream ID descriptor (3Daudio_substreamID_descriptor).

FIG. 20(*a*) illustrates a structure example (Syntax) of a 3D audio stream ID descriptor. Further, FIG. 20(*b*) illustrates content (Semantics) of main information in the structure example.

An 8-bit field of "descriptor_tag" illustrates a descriptor type. In this example, a 3D audio stream ID descriptor is indicated. An 8-bit field of "descriptor_length" indicates a length (size) of the descriptor and a number of following bytes are indicated as the descriptor length. An 8-bit field of "audio_streamID" indicates an identifier of a substream.

Figure 21:
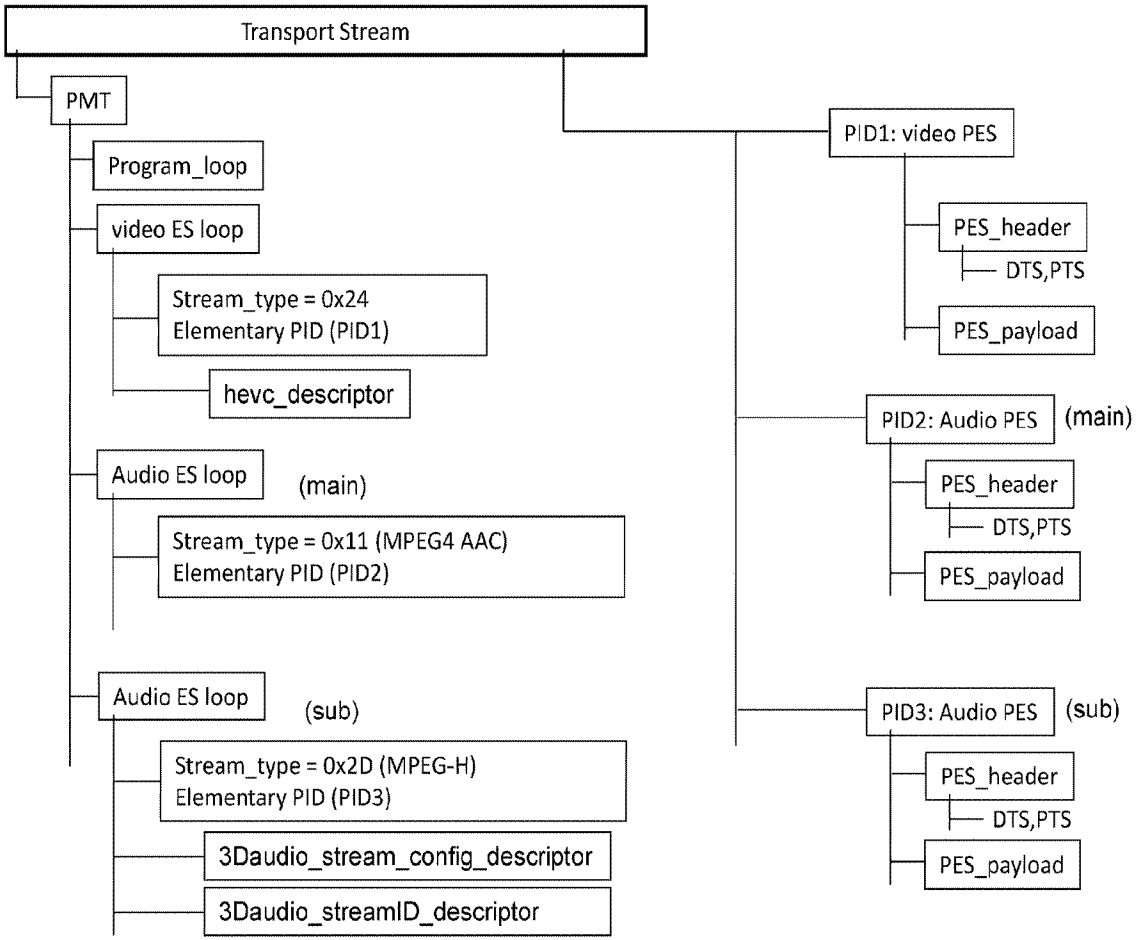
FIG. 21 is a diagram illustrating a configuration example of a transport stream in a case that the configuration of the transmission audio stream is the stream configuration (2).

FIG. 21 illustrates a configuration example of a transport stream TS. In this configuration example, there is a PES packet "video PES" of a video stream identified by PID1. Further, in this configuration example, there are PES packets "audio PES" of two audio streams identified by PID2 and PID3 respectively. The PES packet is composed of a PES header (PES_header) and a PES payload (PES_payload). In the PES header, time stamps of DTS and PTS are inserted. The synchronization between the devices can be maintained in the entire system by applying the time stamps and matching the time stamps of PID2 and PID3 when multiplexing, for example.

In the PES packet "audio PES" of the audio stream (main stream) identified by PID2, channel encoded data of MPEG4 AAC is included. On the other hand, in the PES packet "audio PES" of the audio stream (substream) identified by PID3, object encoded data of the MPEG-H 3D Audio is included.

Further, in the transport stream TS, a program map table (PMT) is included as program specific information (PSI). The PSI is information that describes to which program each elementary stream included in the transport stream belongs. In the PMT, there is a program loop (Program loop) that describes information related to the entire program.

Further, in the PMT, there is an elementary stream loop including information related to each elementary stream. In this configuration example, there is a video elementary stream loop (video ES loop) corresponding to the video stream as well as audio elementary stream loops (audio ES loop) corresponding to the two audio streams.

In the video elementary stream loop (video ES loop), corresponding to the video stream, information such as a stream type and a packet identifier (PID) is placed and a descriptor that describes information related to the video stream is also placed. A value of "Stream_type" of the video stream is set to "0x24," the PID information is assumed to indicate PID1 that is allocated to the PES packet "video PES" of the video stream as described above. An HEVC descriptor is also placed as a descriptor.

In the audio elementary stream loop (audio ES loop) corresponding to the audio stream (main stream), information such as a stream type and a packet identifier (PID) is placed and a descriptor that describes information related to the audio stream is also placed, corresponding to the audio stream. A value of "Stream_type" of the audio stream is set as "0x11, " and the PID information is assumed to indicate PID2 which is applied to the PES packet "audio PES" of the audio stream (main stream) as described above.

Further, in the audio elementary stream loop (audio ES loop) corresponding to the audio stream (substream), information such as a stream type and a packet identifier (PID) is placed and a descriptor that describes information related to the audio stream is also placed, corresponding to the audio stream. A value of "Stream_type" of the audio stream is set to "0x2D, " the PID information is assumed to indicate PID3 applied to the PES packet "audio PES" of the audio stream (main stream) as described above. As the descriptor, the above described 3D audio stream configuration descriptor and 3D audio stream ID descriptor are placed.

An operation of the stream generation unit 110B illustrated in FIG. 17 will be briefly explained. The video data SV is provided to the video encoder 122. In the video encoder 122, the video data SV is encoded and a video stream including the encoded video data is generated.

The channel data composing the audio data SA is supplied to the audio channel encoder 123. In the audio channel encoder 123, the channel data is encoded with MPEG4 AAC and an audio stream (channel encoded data) as a main stream is generated.

Further, the object data composing the audio data SA is supplied to the audio object encoders 124-1 to 124-N. The audio object encoders 124-1 to 124-N respectively encode the object data with MPEG-H 3D Audio and generate audio streams (object encoded data) as substreams.

The video stream generated in the video encoder 122 is supplied to the TS formatter 125. Further, the audio stream (main stream) generated in the audio channel encoder 113 is supplied to the TS formatter 125. Further, the audio streams (substreams) generated in the audio object encoders 124-1 to 124-N are provided to the TS formatter 125. In the TS formatter 125, the streams provided from each encoder are packetized as PES packets and further multiplexed as transport packets, and a transport stream TS as a multiplexed stream is obtained.

Further, the TS formatter 115 inserts a 3D audio stream configuration descriptor in the audio elementary stream loop corresponding to at least one or more substream in the predetermined number of substreams. In the 3D audio stream configuration descriptor, attribute information indicating an attribute of respective pieces of object encoded data of the predetermined number of groups, stream correspondence relation information to which substream each piece of object encoded data of the predetermined number of groups belongs, or the like are included.

Further, in the TS formatter 115, in the audio elementary stream loop corresponding to the substream, that is, in the audio elementary stream loops respectively corresponding to predetermined number of substreams, a 3D audio stream ID descriptor is inserted. In this descriptor, stream identifier information indicating each stream identifier of the predetermined number of audio streams is included.

[Configuration Example of Service Receiver]

Figure 22:
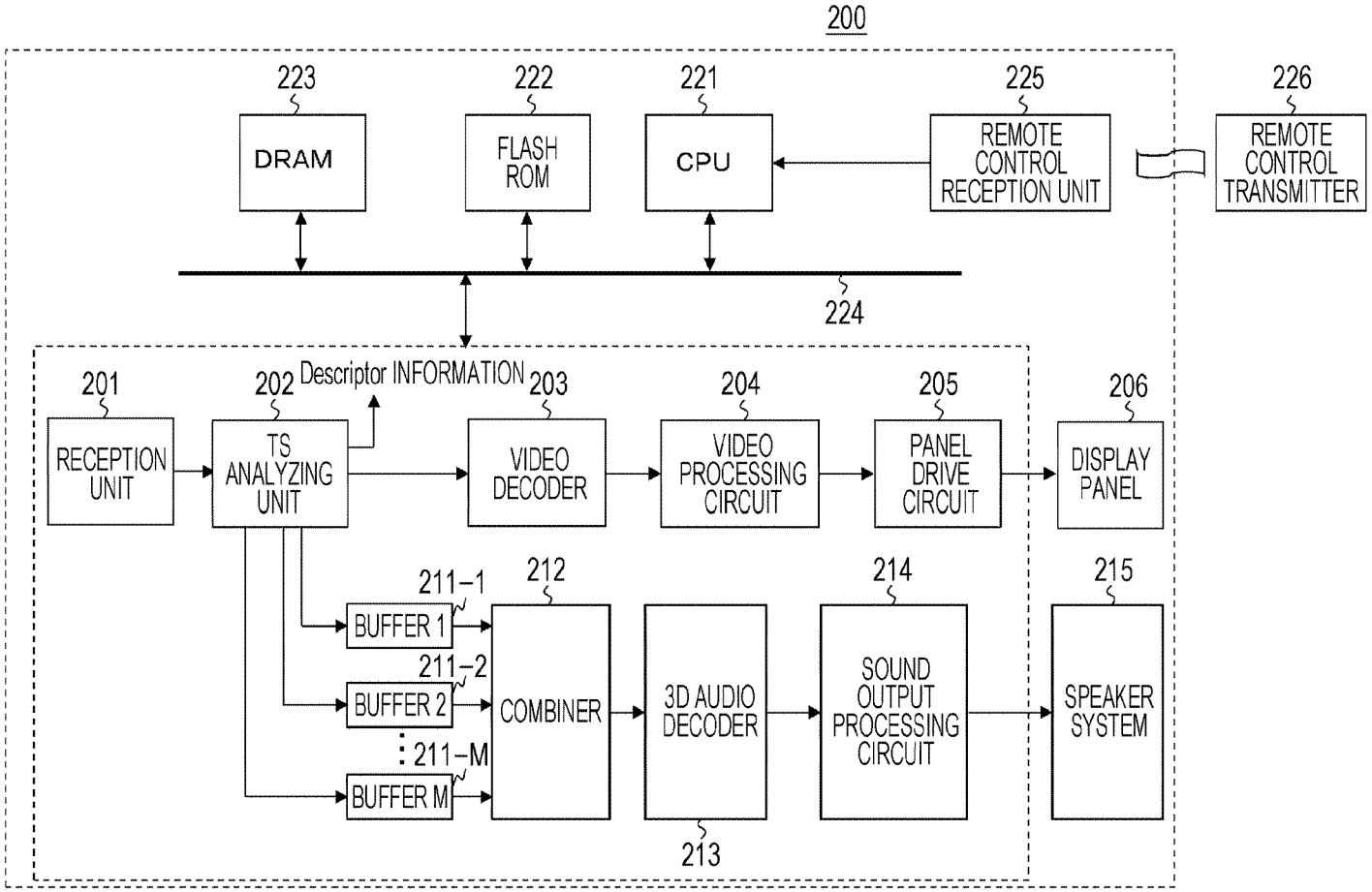
FIG. 22 is a block diagram illustrating a configuration example of a service receiver.

FIG. 22 illustrates a configuration example of the service receiver 200. The service receiver 200 includes a reception unit 201, a TS analyzing unit 202, a video decoder 203, a video processing circuit 204, a panel drive circuit 205, and a display panel 206. Further, the service receiver 200 includes multiplexing buffers 211-1 to 211-M, a combiner 212, a 3D audio decoder 213, a sound output processing circuit 214, and a speaker system 215. Further, the service receiver 200 includes a CPU 221, a flash ROM 222, a DRAM 223, an internal bus 224, a remote control reception unit 225, and a remote control transmitter 226.

The CPU 221 controls operation of each unit in the service receiver 200. The flash ROM 222 stores control software and keeps data. The DRAM 223 composes a work area of the CPU 221. The CPU 221 starts software by developing the software or data read from the flash ROM 222 in the DRAM 223 and controls each unit in the service receiver 200.

The remote control reception unit 225 receives a remote control signal (remote control code) transmitted from the remote control transmitter 226 and supplies the signal to the CPU 221. On the basis of the remote control code, the CPU 221 controls each unit in the service receiver 200. The CPU 221, the flash ROM 222, and the DRAM 223 are connected to the internal bus 224.

The reception unit 201 receives a transport stream TS, which is transmitted from the service transmitter 100 by using a broadcast wave or a packet through a network. The transport stream TS includes a predetermined number of audio streams in addition to a video stream.

Figure 23:
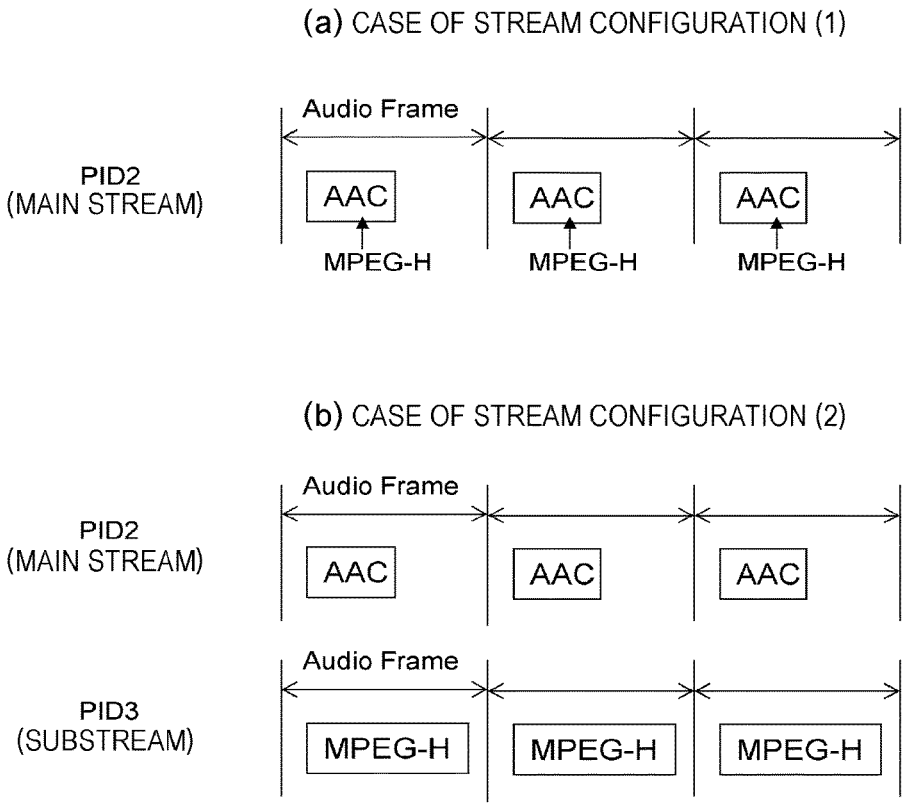
FIGS. 23(*a*) and 23(*b*) are diagrams for explaining configurations of received audio streams (stream configuration (1) and stream configuration (2)).

FIGS. 23(*a*) and 23(*b*) illustrate examples of an audio stream to be received. FIG. 23(*a*) illustrates an example of a case of the stream configuration (1). In this case, there is only a main stream that includes channel encoded data, which is encoded with MPEG4 AAC, and object encoded data of a predetermined number of groups, which is encoded with MPEG-H 3D Audio, is embedded in a user data area thereof. The main stream is identified by PID2.

FIG. 23(*b*) illustrates an example of a case of the stream configuration (2). In this case, there is a main stream that includes channel encoded data encoded with MPEG4 AAC and there are a predetermined number of substreams, one substream in this example, including object encoded data of the predetermined number of groups, which is encoded with MPEG-H 3D Audio. The main stream is identified with PID2 and the substream is identified with PID3. Here, it is noted that, in the stream configuration, the main stream may be identified with PID3 and the substream may be identified with PID2.

The TS analyzing unit 202 extracts a packet of a video stream from the transport stream TS and transmits the packet of the video stream to the video decoder 203. The video decoder 203 reconfigures a video stream from a packet of the video extracted in the TS analyzing unit 202 and obtains uncompressed image data by performing a decode process.

The video processing circuit 204 performs a scaling process and an image quality adjustment process on the video data obtained in the video decoder 203 and obtains video data for displaying. The panel drive circuit 205 drives the display panel 206 on the basis of the image data for displaying obtained in the video processing circuit 204. The display panel 206 is composed of, for example, a liquid crystal display (LCD) or an organic electroluminescence display (organic EL display).

Further, the TS analyzing unit 202 extracts various information such as descriptor information from the transport stream TS and transmits the information to the CPU 221. In the case of the stream configuration (1), the various information includes information of an ancillary data descriptor (Ancillary_data_descriptor) and a 3D audio stream configuration descriptor (3Daudio_stream_config_descriptor) (see FIG. 16). Based on the descriptor information, the CPU 221 can recognize that object encoded data is embedded in the user data area of the main stream included in the channel encoded data, and recognizes an attribute or the like of the object encoded data of each group.

Further, in the case of the stream configuration (2), the various information includes information of a 3D audio stream configuration descriptor (3Daudio_stream_config_descriptor) and a 3D audio stream ID descriptor (3Daudio_substreamID_descriptor) (see FIG. 21). Based on the descriptor information, the CPU 221 recognizes an attribute of the object encoded data of each group and which substream the object encoded data of each group is included, or the like.

Further, under the control by the CPU 221, the TS analyzing unit 202 selectively extracts a predetermined number of audio streams included in the transport stream TS by using a PID filter. In other words, in the case of the stream configuration (1), the main stream is extracted. On the other hand, in the case of the stream configuration (2), the main stream is extracted and the predetermined number of substreams are extracted.

The multiplexing buffers 211-1 to 211-M respectively import audio streams (only the main stream, or the main stream and substream) extracted in the TS analyzing unit 202. Here, the number M of the multiplexing buffers 211-1 to 211-M is assumed to be a necessary and sufficient number and, in an actual operation, the number of buffers as many as the number of audio streams extracted in the TS analyzing unit 202 is used.

The combiner 212 reads, for each audio frame, an audio stream from the multiplexing buffer to which each audio stream to be extracted by the TS analyzing unit 202 is imported among the multiplexing buffers 211-1 to 211-M, and transmits the audio stream to the 3D audio decoder 213.

Under the control by the CPU 221, the 3D audio decoder 213 extracts channel encoded data and object encoded data, performs a decode process, and obtains audio data to drive each speaker of the speaker system 215. In this case, in the case of the stream configuration (1), channel encoded data is extracted from the main stream and object encoded data is extracted from the user data area. On the other hand, in a case of the stream configuration (2), channel encoded data is extracted from the main stream and object encoded data is extracted from the substream.

When decoding the channel encoded data, the 3D audio decoder 213 performs a process of downmixing and upmixing for the speaker configuration of the speaker system 215 according to need and obtains audio data to drive each speaker. Further, when decoding the object encoded data, the 3D audio decoder 213 calculates speaker rendering (a mixing ratio for each speaker) on the basis of the object information (metadata), and mixes the audio data of the object with the audio data to drive each speaker according to the calculation result.

The sound output processing circuit 214 performs a necessary process such as a D/A conversion, amplification, or the like on the audio data, which is obtained in the 3D audio decoder 213 and used to drive each speaker, and supplies the data to the speaker system 215. The speaker system 215 includes a plurality of speakers of a plurality of channels such as 2 channel, 5.1 channel, 7.1 channel, 22.2 channel, and the like.

An operation of the service receiver 200 illustrated in FIG. 22 will be briefly explained. The reception unit 201 receives a transport stream TS from the service transmitter 100, which is transmitted by using a broadcast wave or a packet through a network. The transport stream TS includes a predetermined number of audio streams in addition to a video stream.

For example, in the case of the stream configuration (1), as an audio stream, there is only a main stream which includes channel encoded data encoded with MPEG4 AAC and, in the user data area thereof, a predetermined number of groups of object encoded data encoded with MPEG-H 3D Audio is embedded.

Further, for example, in the case of the stream configuration (2), as an audio stream, there is a main stream including channel encoded data, which is encoded with MPEG4 AAC, and there are a predetermined number of substreams including object encoded data, which is encoded with MPEG-H 3D Audio, of a predetermined number of groups.

In the TS analyzing unit 202, a packet of a video stream is extracted from the transport stream. TS and supplied to the video decoder 203. In the video decoder 203, a video stream is reconfigured from the packet of video extracted in the TS analyzing unit 202 and a decode process is performed to obtain uncompressed video data. The video data is supplied to the video processing circuit 204.

The video processing circuit 204 performs a scaling process, an image quality adjustment process or the like on the video data obtained in the video decoder 203 and obtains video data for displaying. The video data for displaying is supplied to the panel drive circuit 205. On the basis of the video data for displaying, the panel drive circuit 205 drives the display panel 206. With this configuration, on the display panel 206, an image corresponding to the video data for displaying is displayed.

Further, in the TS analyzing unit 202, various information such as descriptor information is extracted from the transport stream TS and transmitted to the CPU 221. In the case of the stream configuration (1), the various information also includes information of an ancillary data descriptor and a 3D audio stream configuration descriptor (see FIG. 16). Based on the descriptor information, the CPU 221 recognizes that the object encoded data is embedded in the user data area of the main stream including the channel encoded data and also recognizes an attribute of object encoded data of each group.

Further, in the case of the stream configuration (2), the various information also includes information of a 3D audio stream configuration descriptor and a 3D audio stream ID descriptor (see FIG. 21). Based on the descriptor information, the CPU 221 recognizes the attribute of the object encoded data of each group, or to which substream the object encoded data of each group is included.

Under the control by the CPU 221, in the TS analyzing unit 202, a predetermined number of audio streams included in the transport stream TS are selectively extracted by using a PID filter. In other words, in the case of the stream configuration (1), the main stream is extracted. On the other hand, in the case of the stream configuration (2), the main stream is extracted and a predetermined number of substreams are also extracted.

In the multiplexing buffers 211-1 to 211-M, the audio stream (only the main stream, or the main stream and substream) extracted in the TS analyzing unit 202 is imported. In the combiner 212, from each multiplexing buffer in which the audio stream is imported, the audio stream is read from each audio frame and supplied to the 3D audio decoder 213.

Under the control by the CPU 221, in the 3D audio decoder 213, the channel encoded data and object encoded data are extracted, a decode process is performed, and audio data to drive each speaker of the speaker system 215 is obtained. Here, in the case of the stream configuration (1), the channel encoded data is extracted from the main stream and the object encoded data is also extracted from the user data area thereof. On the other hand, in the case of the stream configuration (2), the channel encoded data is extracted from the main stream and the object encoded data is extracted from the substream.

Here, when the channel encoded data is decoded, a process of downmixing or upmixing for the speaker configuration of the speaker system 215 is performed according to need and audio data for driving each speaker is obtained. Further, when the object encoded data is decoded, speaker rendering (a mixing ratio for each speaker) is calculated on the basis of object information (metadata), and, according to the calculated result, audio data of the object is mixed to the audio data for driving each speaker.

The audio data for driving each speaker obtained in the 3D audio decoder 213 is supplied to the sound output processing circuit 214. In the sound output processing circuit 214, a necessary process such as a D/A conversion, amplification, or the like is performed on the audio data for driving each speaker. Then, the processed audio data is supplied to the speaker system 215. With this configuration, a sound output corresponding to the display image on the display panel 206 is obtained from the speaker system 215.

Figure 24:
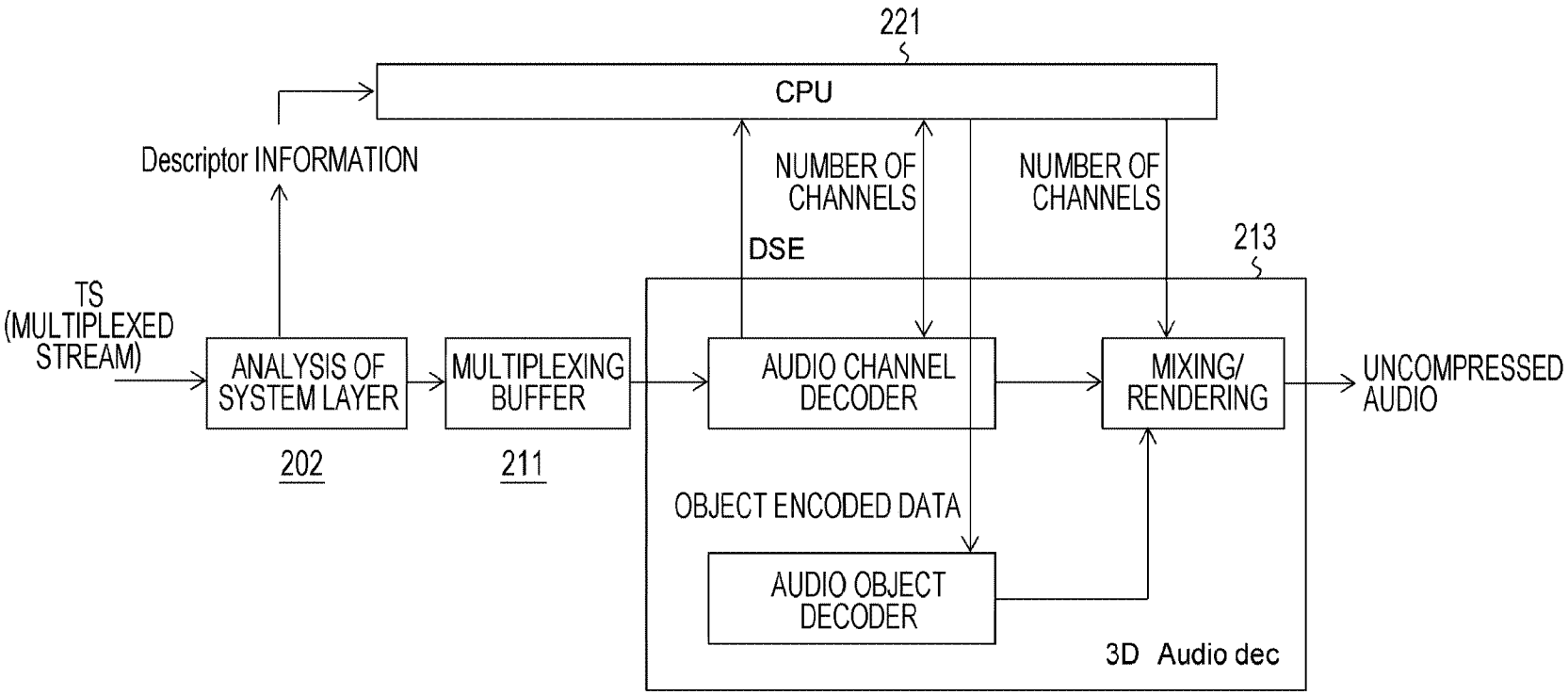
FIG. 24 is a diagram schematically illustrating a decode process in a case that the configuration of the received audio stream is the stream configuration (1).

FIG. 24 schematically illustrates an audio decode process in a case of the stream configuration (1). A transport stream TS as a multiplexed stream is input to the TS analyzing unit 202. In the TS analyzing unit 202, a system layer analysis is performed and descriptor information (information of an ancillary data descriptor and a 3D audio stream configuration descriptor) is supplied to the CPU 221.

On the basis of the descriptor information, the CPU 221 recognizes that the object encoded data is embedded to the user data area of the main stream including the channel encoded data and also recognizes the attribute of the object encoded data of each group. Under the control by the CPU 221, in the TS analyzing unit 202, a packet of the main stream is selectively extracted by using a PID filter and imported to the multiplexing buffer 211 (211-1 to 211-M).

In the audio channel decoder of the 3D audio decoder 213, a process is performed on the main stream imported to the multiplexing buffer 211. In other words, in the audio channel decoder, a DSE in which object encoded data is placed is extracted from the main stream and transmitted to the CPU 221. Here, in an audio channel decoder of a related receiver, the compatibility is maintained since the DSE is read and discarded.

Further, in the audio channel decoder, channel encoded data is extracted from the main stream and a decode process is performed so that audio data for driving each speaker is obtained. In this case, information of the number of channels is transmitted between the audio channel decoder and the CPU 221 and a process of downmixing and upmixing for the speaker configuration of the speaker system 215 is performed according to need.

In the CPU 221, a DSE analysis is performed and the object encoded data placed therein is transmitted to an audio object decoder of the 3D audio decoder 213. In the audio object decoder, the object encoded data is decoded, and metadata and audio data of the object are obtained.

The audio data for driving each speaker obtained in the audio channel encoder is supplied to the mixing/rendering unit. Further, the metadata and audio data of the object obtained in the audio object decoder are also supplied to the mixing/rendering unit.

On the basis of the metadata of the object, in the mixing/rendering unit, a decode output is performed by calculating mapping of the audio data of the object to a speech space with respect to a speaker output target, and additively combining the calculation result to channel data.

Figure 25:
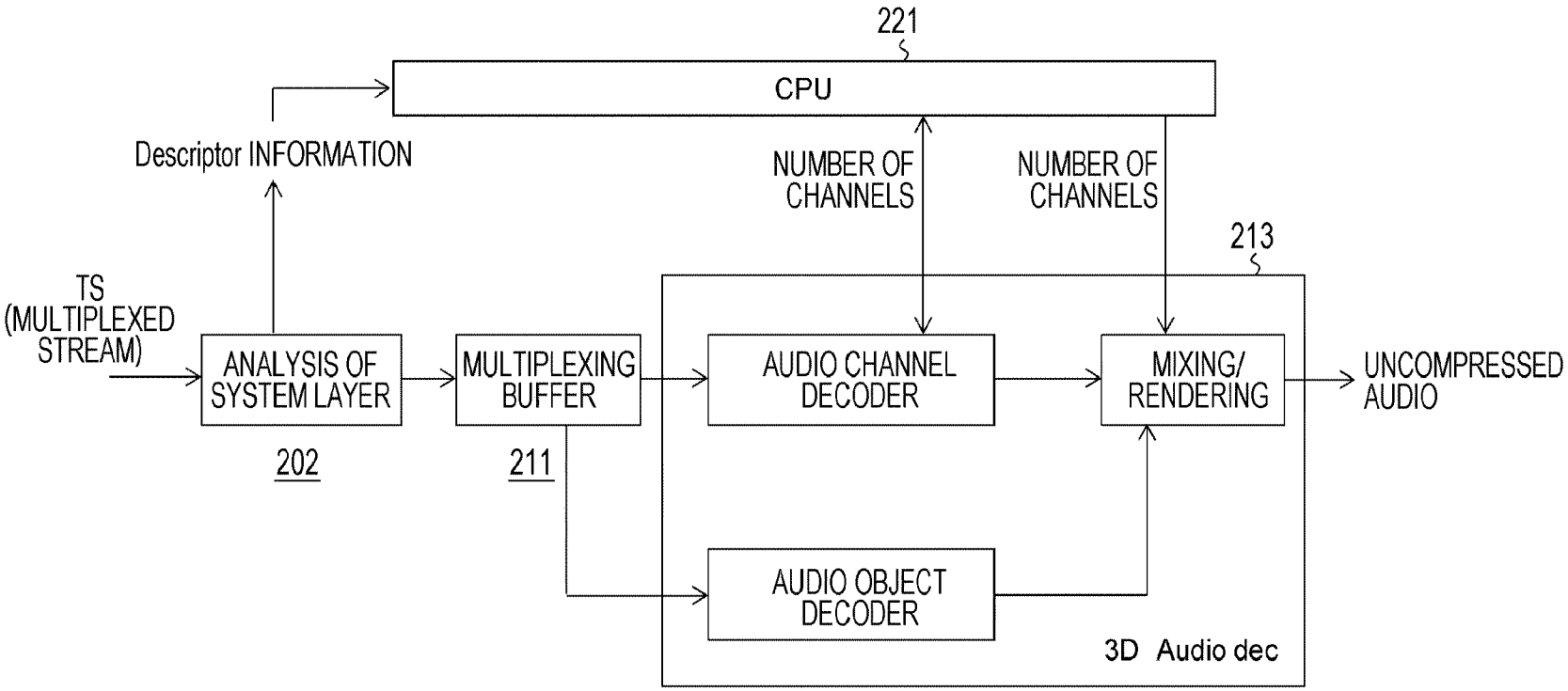
FIG. 25 is a diagram schematically illustrating a decode process in a case that the configuration of the received audio stream is the stream configuration (2).

FIG. 25 schematically illustrates an audio decode process in the case of the stream configuration (2). A transport stream TS as a multiplexed stream is input to the TS analyzing unit 202. In the TS analyzing unit 202, a system layer analysis is performed and descriptor information (information of a 3D audio stream configuration descriptor and a 3D audio stream ID descriptor) is supplied to the CPU 221.

On the basis of the descriptor information, the CPU 221 recognizes the attribute of the object encoded data of each group and al so recognizes to which substream the object encoded data of each group is included, from the descriptor information. Under the control by the CPU 221, in the TS analyzing unit 202, packets of a main stream and a predetermined number of substreams are selectively extracted by using a PID filter and imported to the multiplexing buffer 211 (211-1 to 211-M). Here, in a related receiver, packets of the substreams are not extracted by using a PID filter and only a main stream is extracted so that the compatibility is maintained.

In the audio channel decoder of the 3D audio decoder 213, channel encoded data is extracted from the main stream imported to the multiplexing buffer 211 and a decode process is performed so that audio data for driving each speaker can be obtained. In this case, information of the number of channels is transmitted between the audio channel decoder and the CPU 221 and a process of downmixing and upmixing for the speaker configuration of the speaker system 215 is performed according to need.

Further, in the audio object decoder of the 3D audio decoder 213, necessary object encoded data of a predetermined number of groups is extracted from the predetermined number of substreams imported to the multiplexing buffer 211 on the basis of user's selection or the like and a decode process is performed so that metadata and audio data of the object can be obtained.

The audio data for driving each speaker obtained in the audio channel encoder is supplied to the mixing/rendering unit. Further, the metadata and audio data of the object obtained in the audio object decoder are supplied to the mixing/rendering unit.

On the basis of the metadata of the object, in the mixing/rendering unit, a decode output is performed by calculating mapping of the audio data of the object to a speech space with respect to the speaker output target and additively combining the calculation result to the channel data.

As described above, in the transceiving system 10 illustrated in FIG. 1, the service transmitter 100 transmits a predetermined number of audio streams including channel encoded data and object encoded data that compose the 3D audio transmission data, and the predetermined number of audio streams are generated so that the object encoded data is discarded in a receiver that is not compatible with the object encoded data. Thus, without deteriorating an efficient usage of the transmission band, a new 3D audio service can be provided as maintaining the compatibility with a related audio receiver.

<2. Modification Examples>

Figure 26:
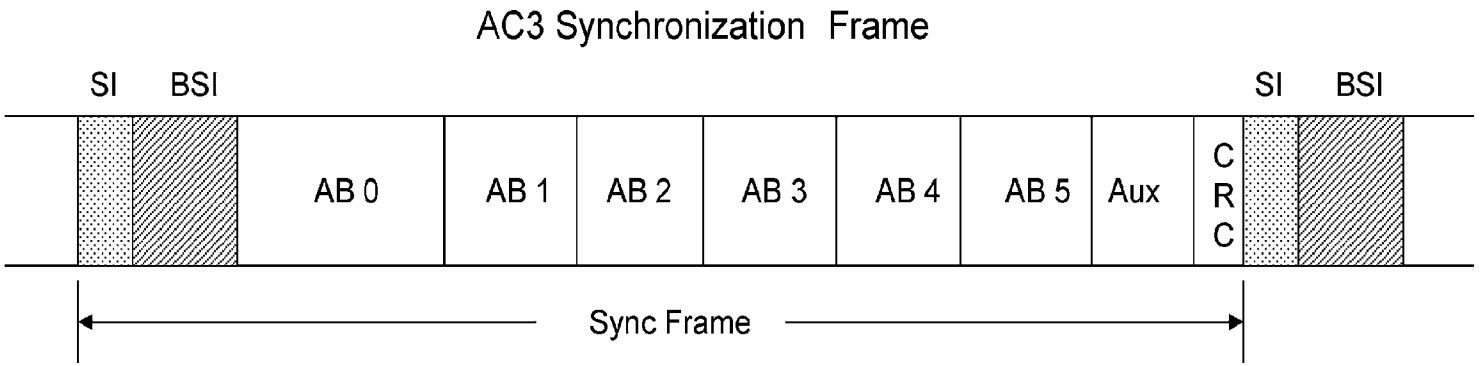
FIG. 26 is a diagram illustrating a structure of an AC3 frame (AC3 Synchronization Frame).

Here, according to the above described embodiment, an example that the channel encoded data encoding method is MPEG4 AAC has been described; however, other encoding methods such as AC3 and AC4 for example can also be considered in a similar manner. FIG. 26 illustrates a structure of an AC3 frame (AC3 Synchronization Frame). The channel data is encoded so that a total size of "Audblock 5," "mantissa data," "AUX," and "CRC" does not exceed three eighths of the entire size. In a case of AC3, metadata MD is inserted to the area of "AUX." FIG. 27 illustrates a configuration (syntax) of auxiliary data (Auxiliary Data) of AC3.

When "auxdatae" is "1," the "aux data" is made to be enabled, and the data in the size which is indicated by the 14 bits (in a bit unit) of "auxdatal" is defined in "auxbits." The size of "auxbits" in this case is written in "nauxbits." In a case of the stream configuration (1), "metadata ( )" illustrated in above FIG. 8(*a*) is inserted in the field of "auxbits," and object encoded data is placed in the field of "data_byte."

Figures 27, 28:
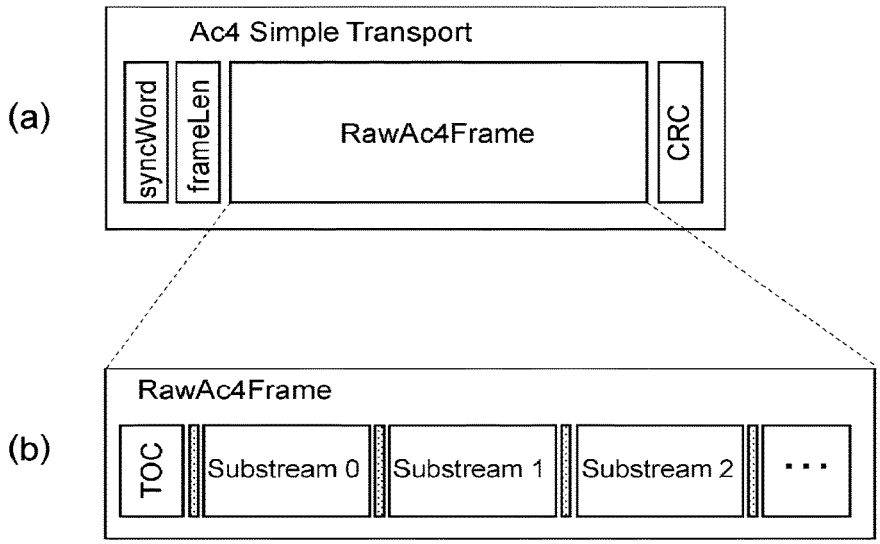
FIG. 27 is a diagram illustrating a configuration example of AC3 auxiliary data (Auxiliary Data).
FIGS. 28(*a*) and 28(*b*) are diagrams illustrating a structure of a layer of an AC4 simple transport (Simple Transport).

FIG. 28(*a*) illustrates a structure of a layer of an AC4 simple transport (Simple Transport). AC4 is one of AC3 audio encoding format for the next generation. There are a field of a syncword (syncword), a field of a frame length (frame Length), a field of "RawAc4Frame" as an encoded data field, and a CRC field. As illustrated in FIG. 28(*b*), in the field of "RawAc4Frame," there is a field of Table Of Content (TOC) in the beginning and there are fields of a predetermined number of substreams (Substream) thereafter.

Figures 29, 30:
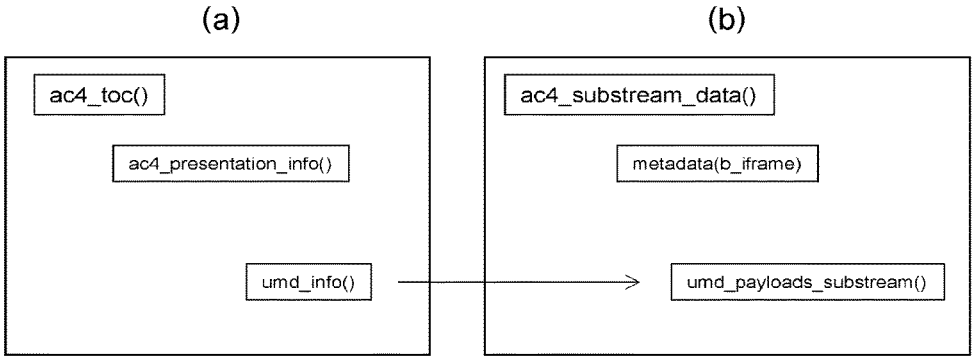
FIGS. 29(*a*) and 29(*b*) are diagrams illustrating outline configurations of a TOC (ac4_toc( )) and a substream (ac4_substream data( )).
FIG. 30 is a diagram illustrating a configuration example of "umd_info( )" in the TOC (ac4_toc( )).

As illustrated in FIG. 29(*b*), in the substream (ac4_substream_data ( )), there is a metadata area (metadata) and afield of "umd_payloads_substream ( )" is provided therein. In the case of the stream configuration (1), object encoded data is placed in the field of "umd_payloads_substream( )."

Here, as illustrated in FIG. 29(*a*), there is a field of "ac4_presentation_info( )" in TOC (ac4_toc( )), and further there is a field of "umd_info( )" therein, which indicates that there is metadata inserted in the field of "umd_payloads_substream( )).

FIG. 30 illustrates a configuration (syntax) of "umd_info( )." A field of "umd_version" indicates a version number of a umd syntax. "K_id" indicates that arbitrary information is contained as '0x6.' The combination of the version number and the value of "k_id" is defined to indicate that there is metadata inserted in the payload of "umd_payloads_substream( )."

FIG. 31 illustrates a configuration (syntax) of "umd_payloads_substream( )." A 5-bit field of "umd_payload_id" is an ID value indicating that "object_data_byte" is contained and the value is assumed to be a value other than "0." A 16-bit field of "umd_payload_size" indicates a number of bits subsequent to the field. An 8-bit field of "userdata_sync-code" is a start code of metadata and indicates content of the metadata. For example, "0x10" indicates that it is object encode data of the MPEG-H system (MPEG-H 3D Audio). In the area of "object_data_byte," the object encoded data is placed.

Further, the above described embodiment describes an example that the channel encoded data encoding method is MPEG4 AAC, the object encoded data encoding method is MPEG-H 3D Audio, and the encoding methods of the channel encoded data and object encoded data are different. However, it may be considered a case that the encoding methods of the two types of encoded data are the same method. For example, there may be a case that the channel encoded data encoding method is AC4 and the object encoded data encoding method is also AC4.

Further, the above described embodiment describes an example that first encoded data is channel encoded data and the second encoded data which is related to the first encoded data is object encoded data. However, the combination of the first encoded data and the second encoded data is not limited to this example. The present technology can similarly be applied to a case of performing various scalable expansions, which are, for example, an expansion of channel number, a sampling rate expansion.

(Example of Expansion of Channel Number)

Encoded data of related 5.1 channel is transmitted as the first encoded data, and encoded data of added channel is transmitted as the second encoded data. A related decoder decodes only an element of 5.1 channel and a decoder compatible with the additional channel decodes all elements.

(Sampling Rate Expansion)

Encoded data of audio sample data with a related audio sampling rate is transmitted as the first encoded data, and encoded data of audio sample data with a higher sampling rate is transmitted as the second encoded data. A related decoder decodes only related sampling rate data, and a decoder compatible with a higher sampling rate decodes all data.

Further, the above described embodiment describes an example that the container is a transport stream (MPEG-2 TS). However, the present technology can also be applied to a system in which data is delivered by a container in MP4 or in other formats in a similar manner. For example, the system is an MPEG-DASH based stream deliver system or a transceiving system that handles an MPEG media transport (MMT) structure transmission stream.

Further, the above described embodiment describes an example that the first encoded data is channel encoded data, and the second encoded data is object encoded data. However, it may be considered a case that the second encoded data is another type of channel encoded data or includes object encoded data and channel encoded data.

Here, the present technology may employ the following configurations.

(1)

A transmission device including:

an encoding unit configured to generate a predetermined number of audio streams including first encoded data and second encoded data which is related to the first encoded data; and a transmission unit configured to transmit a container in a predetermined format including the generated predetermined number of audio streams, wherein the encoding unit generates the predetermined number of audio streams so that the second encoded data is discarded in a receiver which is not compatible with the second encoded data.

(2)

The transmission device according to (1), wherein an encoding method of the first encoded data and an encoding method of the second encoded data are different.

(3)

The transmission device according to (2), wherein the first encoded data is channel encoded data and the second encoded data is object encoded data.

(4)

The transmission device according to (3), wherein the encoding method of the first encoded data is MPEG4 AAC and the encoding method of the second encoded data is MPEG-H 3D Audio.

(5)

The transmission device according to any of (1) to (4), wherein the encoding unit generates the audio streams having the first encoded data and embeds the second encoded data in a user data area of the audio streams.

(6)

The transmission device according to (5), further including an information insertion unit configured to insert, in a layer of the container, identification information identifying that there is the second encoded data, which is related to the first encoded data, embedded in the user data area of the audio streams having the first encoded data and included in the container.

(7)

The transmission device according to (5) or (6), wherein the first encoded data is channel encoded data and the second encoded data is object encoded data, and the object encoded data of a predetermined number of groups is embedded in the user data area of the audio stream, the transmission device further including an information insertion unit configured to insert, in a layer of the container, attribute information that indicates an attribute of each piece of the object encoded data of the predetermined number of groups.

(8)

The transmission device according to any of (1) to (4), wherein the encoding unit generates a first audio stream including the first encoded data and generates a predetermined number of second audio streams including the second encoded data.

(9)

The transmission device according to (8), wherein object encoded data of a predetermined number of groups is included in the predetermined number of second audio streams, the transmission device further including an information insertion unit configured to insert, in a layer of the container, attribute information that indicates an attribute of each piece of object encoded data of the predetermined number of groups.

(10)

The transmission device according to (9), wherein the information insertion unit further inserts, in the layer of the container, stream correspondence relation information that indicates in which of the second audio streams each piece of the object encoded data of the predetermined number of groups is included, respectively.

(11)

The transmission device according to (10), wherein the stream correspondence relation information is information that indicates a correspondence relation between a group identifier identifying each piece of the object encoded data of the predetermined number of groups and a stream identifier identifying each of the predetermined number of second audio streams.

(12)

The transmission device according to (11), wherein the information insertion unit further inserts, in the layer of the container, stream identifier information that indicates each stream identifier of the predetermined number of second audio streams.

(13)

A transmission method including:

an encoding step of generating a predetermined number of audio streams including first encoded data and second encoded data which is related to the first encoded data; and a transmission step of transmitting, by a transmission unit, a container in a predetermined format including the generated predetermined number of audio streams, wherein, in the encoding step, the predetermined number of audio streams are generated so that the second encoded data is discarded in a receiver which is not compatible with the second encoded data.

(14)

A reception device including a reception unit configured to receive a container in a predetermined format including a predetermined number of audio streams having first encoded data and second encoded data which is related to the first encoded data, wherein the predetermined number of audio streams are generated so that the second encoded data is discarded in a receiver which is not compatible with the second encoded data, the reception device further including a processing unit configured to extract the first encoded data and the second encoded data from the predetermined number of audio streams included in the container and process the extracted data.

(15)

The reception device according to (14), wherein an encoding method of the first encoded data and an encoding method of the second encoded data are different.

(16)

The reception device according to (14) or (15), wherein the first encoded data is channel encoded data and the second encoded data is object encoded data.

(17)

The reception device according to any of (14) to (16), wherein the container includes the audio streams having the first encoded data and the second encoded data embedded in a user data area thereof.

(18)

The reception device according to any of (14) to (16), wherein the container includes a first audio stream including the first encoded data and a predetermined number of second audio streams including the second encoded data.

(19)

A reception method including a reception step of receiving, by a reception unit, a container in a predetermined format including a predetermined number of audio streams having first encoded data and second encoded data which is related to the first encoded data, wherein the predetermined number of audio streams are generated so that the second encoded data is discarded in a receiver which is not compatible with the second encoded data, the reception method further including a processing step of extracting the first encoded data and the second encoded data from the predetermined number of audio streams included in the container and processing the extracted data.

A major characteristic of the present technology is that a new 3D audio service can be provided as maintaining the compatibility with a related audio receiver without deteriorating the efficient usage of the transmission band by transmitting an audio stream that includes channel encoded data and obj ect encoded data embedded in a user data area thereof, or by transmitting an audio stream including channel encoded data together with an audio stream including object encoded data (see FIG. 2).

REFERENCE SIGNS LIST

10 Transceiving system
100 Service transmitter
110A, 110B Stream generation unit
112, 122 Video encoder
113, 123 Audio channel encoder
114, 124-1 to 124-N Audio object encoder
115, 125 TS formatter
114 Multiplexor
200 Service receiver
201 Reception unit
202 TS analyzing unit
203 Video decoder
204 Video processing circuit
205 Panel drive circuit
206 Display panel
211-1 to 211-M Multiplexing buffer
212 Combiner
213 3D audio decoder
214 Sound output processing circuit
215 Speaker system
221 CPU
222 Flash ROM
223 DRAM
224 Internal bus
225 Remote control reception unit
226 Remote control transmitter

The invention claimed is:

1. A transmission device comprising:

encoder circuitry configured to generate a transport stream including a predetermined number of audio streams and a video stream, the predetermined number of audio streams including first encoded data and a predetermined number of groups of second encoded data which is related to the first encoded data, the second encoded data being encoded data of an immersive audio object and a speech dialog object, and the predetermined number of groups including at least a switch group, and insert in a layer of a container associated with a program map table, identification information for the second encoded data and attribute information indicating attributes of the second encoded data in an audio elementary stream loop corresponding to the audio streams and a video elementary stream loop corresponding to the video stream, the program map table being included as program specific information indicating a program to which the video stream included in the transport stream belongs; and a transmitter configured to transmit the container in a predetermined format including the generated predetermined number of audio streams, wherein the encoder circuitry generates the predetermined number of audio streams so that the second encoded data is discarded in a receiver which is not compatible with the second encoded data.

2. The transmission device according to claim 1, wherein an encoding method of the first encoded data and an encoding method of the second encoded data are different.

3. The transmission device according to claim 2, wherein the first encoded data is channel encoded data and the second encoded data is object encoded data.

4. The transmission device according to claim 3, wherein the encoding method of the first encoded data is MPEG4 AAC and the encoding method of the second encoded data is MPEG-H 3D Audio.

5. The transmission device of claim 3, wherein the object encoded data includes a plurality of pieces of objects associated with the immersive audio object and the speech dialog object each including an encoded sample data for rendering by mapping the encoded sample data with a speaker, the encoded sample data being included in a single channel element, one or more channel pair elements, and a low frequency element.

6. The transmission device according to claim 1, wherein the encoder circuitry generates the audio streams having the first encoded data and embeds the second encoded data in a user data area of the audio streams.

7. The transmission device according to claim 6, further comprising:

a processor configured to insert, in the layer of the container, the identification information identifying that there is the second encoded data, which is related to the first encoded data, embedded in the user data area of the audio streams having the first encoded data and included in the container.

8. The transmission device according to claim 1, wherein the encoder circuitry generates a first audio stream including the first encoded data and generates a predetermined number of second audio streams including the second encoded data.

9. The transmission device according to claim 8, wherein object encoded data of the predetermined number of groups is included in the predetermined number of second audio streams, the transmission device further comprising a processor configured to insert, in the layer of the container, attribute information that indicates an attribute of each piece of object encoded data of the predetermined number of groups.

10. The transmission device according to claim 9, wherein the processor further inserts, in the layer of the container, stream correspondence relation information that indicates in which of the second audio streams each piece of the object encoded data of the predetermined number of groups is included, respectively.

11. The transmission device according to claim 10, wherein the stream correspondence relation information indicates a correspondence relation between a group identifier identifying each piece of the object encoded data of the predetermined number of groups and a stream identifier identifying each of the predetermined number of second audio streams.

12. The transmission device according to claim 11, wherein the processor further inserts, in the layer of the container, stream identifier information that indicates each stream identifier of the predetermined number of second audio streams.

13. The transmission device of claim 1, wherein the encoder is further configured to:

insert stream identifier information indicating each stream identifier of the predetermined number of streams when the second encoded data is included in a predetermined number of second audio streams.

14. A transmission method comprising:

generating, by encoding circuitry, a transport stream including a predetermined number of audio streams and a video stream, the predetermined number of audio streams including first encoded data and a predetermined number of groups of second encoded data which is related to the first encoded data, the second encoded data being encoded data of an immersive audio object and a speech dialog object, and the predetermined number of groups including at least a switch group;

inserting by the encoding circuitry, in a layer of a container associated with a program map table, identification information for the second encoded data and attribute information indicating attributes of the second encoded data in an audio elementary stream loop corresponding to the audio streams and a video elementary stream loop corresponding to the video stream, the program map table being included as program specific information indicating a program to which the video stream included in the transport stream belongs; and transmitting, by a transmitter, the container in a predetermined format including the generated predetermined number of audio streams, wherein the predetermined number of audio streams are generated so that the second encoded data is discarded in a receiver which is not compatible with the second encoded data.

15. A reception device comprising:

receiver circuitry configured to receive a container in a predetermined format including a video stream and a predetermined number of audio streams having first encoded data and a predetermined number of groups of second encoded data which is related to the first encoded data, the second encoded data being encoded data of an immersive audio object and a speech dialog object, and the predetermined number of groups including at least a switch group, and identification information for the second encoded data inserted in a layer of the container associated with a program map table, and attribute information indicating attributes of the second encoded data in an audio elementary stream loop corresponding to the audio streams and a video elementary stream loop corresponding to the video stream, the program map table being included as program specific information indicating a program to which the video stream included in a transport stream belongs;

wherein the predetermined number of audio streams are generated so that the second encoded data is discarded when the receiver circuitry is not compatible with the second encoded data, the reception device further comprising a processor configured to extract the first encoded data and the second encoded data from the predetermined number of audio streams included in the container and process the extracted data.

16. The reception device according to claim 15, wherein an encoding method of the first encoded data and an encoding method of the second encoded data are different.

17. The reception device according to claim 15, wherein the first encoded data is channel encoded data and the second encoded data is object encoded data.

18. The reception device according to claim 15, wherein the container includes the audio streams having the first encoded data and the second encoded data embedded in a user data area thereof.

19. The reception device according to claim 15, wherein the container includes a first audio stream including the first encoded data and a predetermined number of second audio streams including the second encoded data.

20. A reception method comprising receiving, by a receiver, a container in a predetermined format including a video stream and a predetermined number of audio streams having first encoded data and a predetermined number of groups of second encoded data which is related to the first encoded data, the second encoded data being encoded data of an immersive audio object and a speech dialog object and the predetermined number of groups including at least a switch group, and identification information for the second encoded data inserted in a layer of the container associated with a program map table, and attribute information indicating attributes of the second encoded data in an audio elementary stream loop corresponding to the audio streams and a video elementary stream loop corresponding to the video stream, the program map table being included as program specific information indicating a program to which the video stream included in a transport stream belongs, wherein the predetermined number of audio streams are generated so that the second encoded data is discarded when the receiver is not compatible with the second encoded data, the reception method further comprising extracting the first encoded data and the second encoded data from the predetermined number of audio streams included in the container and processing the extracted data.

* * * * *